US008396393B2

(12) United States Patent
Igarashi et al.

(10) Patent No.: US 8,396,393 B2
(45) **Date of Patent: *Mar. 12, 2013**

(54) DEVELOPING CARTRIDGE AND IMAGE FORMING DEVICE WITH PRESSING MEMBER

(75) Inventors: Hiroshi Igarashi, Nagoya (JP); Naoya Kamimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/303,948

(22) Filed: Nov. 23, 2011

(65) Prior Publication Data

US 2012/0076536 A1 Mar. 29, 2012

Related U.S. Application Data

(63) Continuation of application No. 12/979,966, filed on Dec. 28, 2010, now Pat. No. 8,086,139, which is a continuation of application No. 11/614,410, filed on Dec. 21, 2006, now Pat. No. 7,869,742.

(30) Foreign Application Priority Data

Dec. 27, 2005 (JP) ..... 2005-376113
May 18, 2006 (JP) ..... 2006-139484

(51) Int. Cl.
*G03G 15/04* (2006.01)

(52) U.S. Cl. ..... 399/119; 399/106; 399/126

(58) Field of Classification Search ..... 399/111, 399/112, 119, 113, 262, 223, 228, 284
See application file for complete search history.

(56) References Cited

U.S. PATENT DOCUMENTS

| | | | |
|---|---|---|---|
| 5,014,095 | A | 5/1991 | Yamada |
| 5,068,691 | A | 11/1991 | Nishio et al. |
| 5,300,979 | A | 4/1994 | Tsukakoshi |
| 6,295,437 | B1 | 9/2001 | Hodoshima et al. |
| 6,708,011 | B2 | 3/2004 | Nomura et al. |
| 6,763,213 | B2 | 7/2004 | Ahn |
| 2003/0156855 | A1 | 8/2003 | Nittani et al. |
| 2004/0062566 | A1 | 4/2004 | Kato et al. |

FOREIGN PATENT DOCUMENTS

| | | |
|---|---|---|
| EP | 1742117 | 10/2007 |
| JP | 62215278 | 9/1987 |
| JP | 4217282 | 8/1992 |
| JP | 7092801 | 4/1995 |
| JP | 07-295461 | 11/1995 |
| JP | 7295460 | 11/1995 |
| JP | 2001-042622 | 2/2001 |
| JP | 2003-263024 | 9/2003 |
| JP | 2004-264519 | 9/2004 |
| JP | 2005-181735 | 7/2005 |
| WO | 2006-079163 | 8/2006 |

OTHER PUBLICATIONS

Office Action Received in counterpart Japanese Application No. 2009-255250, mailed Feb. 16, 2010.
Notice of Reasons of Rejection for Japanese Patent Application No. 2006-139484, mailed Dec. 18, 2008.
Extended European Search Report dated Mar. 5, 2007 in Application No. EP06026634.3.

*Primary Examiner* — Walter Lindsay, Jr.
*Assistant Examiner* — Roy Y Yi
(74) *Attorney, Agent, or Firm* — Banner & Witcoff, Ltd.

(57) ABSTRACT

A developing cartridge that maintains a pressing condition to press a developer carrier against the image carrier is described. The developing cartridge may include a coil spring that presses the developer carrier against the image carrier. The coil spring may include a handle that transmits a pressing force to the coil spring via the contacting member. By doing so, every time the developing cartridge is replaced, a new coil spring and handle can be provided for the color laser printer with the developing cartridge attached. Therefore, a constant pressure by the coil spring can be continuously maintained. Thus, a preferable pressure condition of the developer carrier against the image carrier can be continuously maintained.

22 Claims, 31 Drawing Sheets

27

DEVELOPING CARTRIDGE AND IMAGE FORMING DEVICE WITH PRESSING MEMBER

RELATED APPLICATION INFORMATION

This application claims priority from U.S. patent application Ser. No. 12/979,966, filed Dec. 28, 2010 and U.S. patent application Ser. No. 11/614,410, filed Dec. 21, 2006, now U.S. Pat. No. 7,869,742, which claims priority to Japanese application numbers 2005-376113, filed Dec. 27, 2005, and 2006-139484, filed May 18, 2006, all of whose contents are expressly incorporated herein by reference.

RELATED ART

Tandem-type image forming devices are used to print images on to various media. A plurality of image carriers, each corresponding to each color of yellow, magenta, cyan, and black, are generally horizontally arranged in parallel in the image forming device. For the tandem-type image forming device, the toner images in each color are formed approximately simultaneously on each image carrier. The toner image in each color is then transferred from each of the image carriers to paper that passes past each of the image carriers in sequence. Therefore, a color image can be formed at approximately the same speed as a monochrome image forming device.

A developing cartridge may be capable of being detachably installed on a main body of the image forming device. The developing cartridge provides the toner that is used to develop an electrostatic latent image on the image carrier into a toner image.

For example, one proposed design includes a cartridge with an integrated image carrier in which the image carrier for each color is supported in the cartridge by a frame. The photoconductor cartridge is configured to be removably installed in a main body of the image forming device. Developing cartridges for each color are configured to be removably installed in the cartridge with the integrated image carrier.

The developing cartridge includes a developer carrier to supply toner onto the image carrier. An elastic member such as a spring is provided on the main body of the image forming device. Under the condition in which the developing cartridge is installed on the main body, a pressure is provided to the developing cartridge having an elastic member so that the developer carrier is pressed against the image carrier with the designated pressing force.

However, the pressure that the elastic member imparts to the developing cartridge gradually decreases as the elastic member deteriorates. When the pressure of the elastic member decreases, the pressing force of the developer carrier against the image carrier decreases. Next, due to an insufficient supply of toner to the image carrier because of the reduced pressing force, the latent image on the image carrier fails to develop properly.

SUMMARY

This summary is provided to introduce a selection of concepts in a simplified form that are further described below in the Detailed Description. This summary is not intended to identify key features or essential features of the claimed subject matter.

Aspects of the invention relate to an improved developing cartridge and related imaging formation device that can maintain a preferable pressing condition of the developer carrier against the image carrier.

These and other aspects of the disclosure will be apparent upon consideration of the following detailed description of illustrative embodiments.

BRIEF DESCRIPTION OF DRAWINGS

A more complete understanding of the present invention and the potential advantages thereof may be acquired by referring to the following description of illustrative embodiments in consideration of the accompanying drawings.

DETAILED DESCRIPTION

The various aspects summarized previously may be embodied in various forms. The following description shows by way of illustration of various combinations and configurations in which the aspects may be practiced. It is understood that the described aspects and/or embodiments are merely illustrative examples, and that other aspects and/or embodiments may be utilized and structural and functional modifications may be made, without departing from the scope of the present disclosure.

It is noted that various connections are set forth between elements in the following description. It is noted that these connections in general and, unless specified otherwise, may be direct or indirect and that this specification is not intended to be limiting in this respect.

1. The Overall Structure of an Illustrative Color Laser Printer

Figure 1:
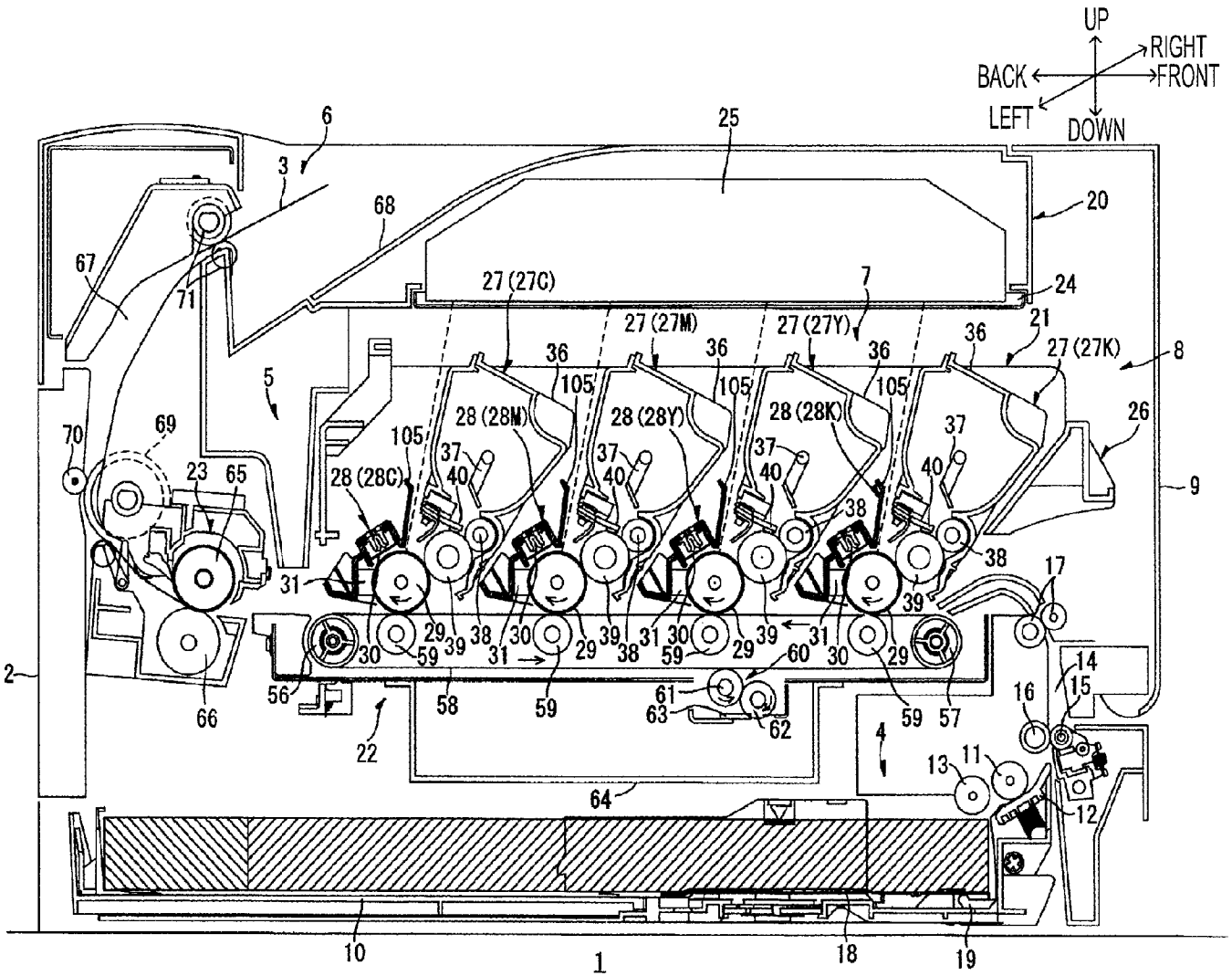
FIG. 1 shows a lateral cross-sectional view that shows an illustrative embodiment of a color laser printer as an example of the color image forming device according to aspects of the present invention.

FIG. 1 is a lateral cross-sectional view that shows an illustrative embodiment of a color laser printer as an example of the color image forming device.

The color laser printer 1 is a transverse tandem-type color laser printer in which a plurality of drum subunits 28 are provided in parallel in the horizontal direction. In a main unit casing 2 of the color laser printer 1 are a paper feeder 4 that feeds a paper 3, an image formation portion 5 that forms the image on the paper 3, and a paper discharge portion 6 that discharges the paper 3 where an image is formed.

The color laser 1 may alternatively include an intermediate image transfer belt (where images from drum subunits 28 provide developer to an intermediate image transfer belt, that later transfers and image to a print medium) used with drum subunits 28 or a photosensitive belt that replaces drum subunits 28.

(1) Main Unit Casing

The main unit casing 2 has an approximately rectangular box shape when viewed from the side. A drum housing space 7 to contain a drum unit 26 is formed within the main unit casing 2.

An opening 8 communicating with the drum housing space 7 may be formed on one side of the main unit casing 2. A front cover 9 (configured to open and close the opening 8) is provided on the lateral surface where the opening 8 is formed. The front cover 9 inclines from the main unit casing 2 to reveal the opening 8, and stands along one of the lateral surfaces of the main unit casing 2 to conceal the opening 8. While the opening 8 is being revealed, the drum unit 26 can be installed into or removed from the drum housing space 7 via the opening 8.

In the following explanation, the side where the front cover 9 is provided (on the right in FIG. 1) is the front side, and the opposite side (on the left in FIG. 1) is the back side. In addition, the left and right are based on the frontal view of the color laser printer 1. Furthermore, unless specifically mentioned, the front/back left/right and top/bottom of the drum unit 26 and developing cartridge 27 are determined in the condition of being installed in the main unit casing 2.

(2) Paper Feeder

The paper feeder 4 may be provided at the bottom inside the main unit casing 2. The paper feeder 4 may include: a paper feed tray 10 that holds paper 3; a separation roller 11 and separation pad 12 that are provided on the top of the front edge of the paper feed tray 10, and that are arranged facing each other; a feed roller 13 that is provided on the back of the separation roller 11; and a feed pathway 14 where the paper 3 passes through.

The feed pathway 14 may be formed in an approximately U-shape when viewed from one side. The upstream edge of the feed pathway 14 is positioned adjacent to the separation roller 11. The downstream edge of the feed pathway 14 is positioned adjacent to a feed belt 58 from the front side.

A paper dust removing roller 15 and a pinch roller 16 may be provided on the front top of the separation roller 11. The paper dust removing roller 15 and the pinch roller 16 are facing each other. A pair of resist rollers 17 can be provided above the paper dust removing roller 15 and the pinch roller 16. The paper dust removing roller 15, the pinch roller 16, and the pair of resist roller are provided in the middle of the feed pathway 14.

A paper pressing plate 18 (on which paper 3 is stacked) is provided inside the paper feed tray 10, A rear edge of the paper pressing plate 18 is supported at the paper feed tray 10 in a movable manner so that a front edge position of the paper pressing plate 18 is movable between a loading position and a paper feed position. In the loading position, the front edge portion of the paper pressing plate 18 is positioned at a bottom floor of the paper feed tray. In the paper feed position, the paper pressing plate 18 is inclined and positioned at the top of the paper feed tray 10.

A lever 19 that lifts the front edge of the paper pressing plate 18 upwards is provided at the bottom of the front edge of the paper feed tray 10. The lever 19 is supported so that the lever 19 can move in the vertical direction at the bottom of the front edge of the paper pressing plate 18.

The front edge of the paper pressing plate 18 is lifted by the movement of the lever 19 so that the paper pressing plate 18 is positioned at the paper feed position.

When the paper pressing plate 18 is positioned at the paper feed position, the uppermost paper 3 on the paper pressing plate 18 is pressed against the paper feed roller 13. The paper 3 is then fed between the separation roller 11 and separation pad 12 by rotation of the paper feed roller 13.

When the paper feed tray 10 is removed from the main unit casing 2, the paper pressing plate 18 is positioned at the loading position.

When the paper pressing plate 18 is positioned at the loading position, the paper 3 can be stacked on the paper pressing plate 18.

The paper 3 is securely held between the separation roller 11 and separation pad 12 by the rotation of the separation roller 11 and is then fed by being individually picked up. The paper 3 passes between the paper dust removing roller 15 and pinch roller 16. The paper dust removing roller 15 removes paper dust on the paper 3. Then the paper is fed along the feed pathway 14 towards the pair of resist rollers 17.

The pair of resist rollers 17 initially prevent paper 3 from passing then feed the paper 3 to the feed belt 58.

(3) Image Forming Portion

The image forming portion 5 includes a scanner 20, a processing portion 21, a transfer portion 22, and a fixing portion 23.

(3-1) Scanner

The scanner 20 is arranged at the top portion of the main unit casing 2. The scanner 20 includes a supporting plate 24 (extending in the front, back, left and right directions) and a scanner unit 25 (positioned on the top of the supporting plate 24). Inside the scanner unit 25, optical members, such as four light sources, a polygon mirror, an fθ lens, a reflective mirror, and an error correction lens may be arranged. The laser beam emitted from each of the light sources based on the image data is deflected and scanned by the polygon mirror. The laser beam next passes through the fθ lens and the error correction lens. The laser beam is then reflected by the reflective mirror. The laser beam finally is irradiated on the surface of the image carriers 29 corresponding to each color.

(3-2) Processing Portion

The processing portion 21 is arranged below the scanner 20 and above the paper feeder 4. The processing portion 21 includes a drum unit 26 and four developing cartridges 27, each of which corresponds to each color.

(3-2-1) Drum Unit

The drum unit 26 includes four drum subunits 28 that correspond to each color. In other words, the drum subunits 28 include a black drum subunit 28K, a yellow drum subunit 28Y, a magenta drum subunit 28M and a cyan drum subunit 28C.

Each of the drum subunits 28 can be arranged in parallel at intervals in the front and back direction. More specifically, from the front to back, the black drum subunit 28K, yellow drum subunit 28Y, magenta drum subunit 28M and cyan drum subunit 28C may be arranged in that order or other order as known in the art.

Each of drum subunits 28 includes a pair of side frames 104 and a center frame 105. The center frame is installed between the pair of side frames 104 (see FIG. 4).

Figure 2:
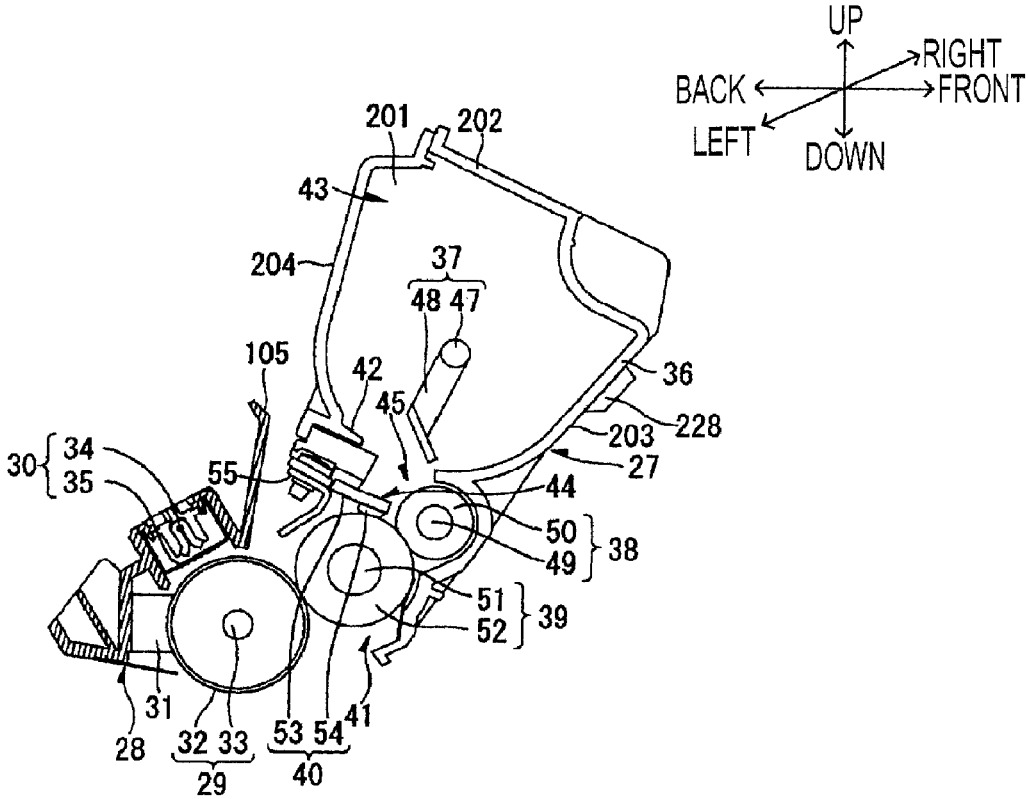
FIG. 2 shows a lateral cross-sectional view that shows the developing cartridge and drum subunit shown in FIG. 1 according to aspects of the present invention.

FIG. 2 is a lateral cross-sectional view of the developing cartridge 27 and drum subunit 28.

Though described in detail below, handle 214 is not shown in FIGS. 1-2.

As shown in FIG. 2, each of the drum subunits 28 may include an image carrier 29, a scorotron-type charger 30, and a cleaning brush 31.

The image carrier 29 includes a cylindrical drum body 32, for which the outer surface is made of a positively chargeable photoconductive polycarbonate layer, which is provided along the left and right direction, and a drum shaft 33 that is arranged along the axis direction of the drum body 32. The drum body 32 is rotatable relative to the drum shaft 33. Each end of the drum shaft 33 is inserted in a corresponding side frame 104 (see FIG. 4). Each end of the drum shaft 33 is supported by the side plate 103, which is described in a later section (see FIG. 4) so that the drum shaft 33 does not rotate. The image carrier 29 rotates by the driving force of the motor (not shown in the drawings) provided in the main unit casing 2 during the image formation.

The scorotron-type charger 30 can be arranged to face the image carrier 29 with an interval, diagonally, on the top rear of the image carrier 29 and is supported by the center frame 105. The scorotron-type charger 30 includes a discharging wire 34 that can be arranged to face the image carrier 29 with an interval and a grid 35 that is provided between the discharging wire 34 and the image carrier 29. During the image formation, when a high voltage is applied to the discharging wire 34, the discharging wire 34 discharges the remaining charge on the surface of the image carrier 29. Further, when a voltage is applied to the grid 35, the surface of the image carrier 29 is uniformly positively charged while the electric charge supplied to the image carrier 29 is controlled.

The cleaning brush 31 is arranged so that the cleaning brush 31 contacts the image carrier 29 at the rear of the image carrier 29. The cleaning brush 31 is supported by the center frame 105. During the image formation, a cleaning bias is applied to the cleaning brush 31.

(3-2-2) Developing Cartridge

The developing cartridges 27 can be, as shown in FIG. 1, arranged so that each of the developing cartridges 27 can be installed in and removed from each of the drum subunits 28 respectively. In other words, the developing cartridges 27 may include a black developing cartridge 27K (that is removably installable in the black drum subunit 28K), a yellow developing cartridge 27Y (that is removably installable in the yellow drum subunit 28Y), a magenta developing cartridge 27M (that is removably installable in the magenta drum subunit 28M), and a cyan developing cartridge 27C (that is removably installable in the cyan drum subunit 28C).

As shown in FIG. 2, each of the developing cartridges 27 may include a developing frame 36, an agitator 37 and a supplying roller 38, a developer carrier 39, and a layer thickness limiting blade 40. The agitator 37, the supplying roller 38, a developer carrier 39, and the layer thickness limiting blade 40 are provided in the developing frame 36.

The developing frame 36 is formed in a box shape in which an opening 41 is formed at the bottom edge of the developing frame. The developing frame 36 is divided into a toner container 43 and a developing chamber 44 with a partition 42. A connecting hole 45 that connects the toner container 43 and developing chamber 44 is provided on the partition 42.

Toner that corresponds to each color is contained in the toner containers 43. More specifically, black toner is contained in the toner container 43 of the black developing cartridge 27K. Yellow toner is contained in the toner container 43 of the yellow developing cartridge 27Y. Magenta toner is contained in the toner container 43 of the magenta developing cartridge 27M. Cyan toner is contained in the toner container 43 of the cyan cartridge 27C.

A positively chargeable, non-magnetic, single component polymerization toner may be used, for instance, as the toner in each of the developing cartridges 27. The polymerization toner is approximately spherical in shape. The main component of the toner is the binding resin that can be obtained by the copolymerization of styrene monomers such as styrene and acrylic monomers. The styrene and acrylic monomers may be acrylic acid, alkyl (C1-C4)acrylate, and alkyl (C1-C4)metaacrylate. The monomers may be made by publicly known polymerization methods such as suspension polymerization. The toner mother particle is formed by adding one or more coloring agents, a charge control agent, and wax into the binding resin. Further another additive may be added to the toner mother particle in order to improve fluidity.

Coloring agents, which correspond to each color, e.g., black, yellow, magenta, and cyan, may be blended to the polymerization toner. In addition, charge control additive may be blended to the polymerization toner. The charge control additive may be a resin that can be obtained by copolymerization of ionic monomers and other monomers. The ionic monomer may have an ionic function group such as an ammonium salt. The other monomers can be styrene monomers or acrylic monomers, which can be copolymerized with the ionic monomers. Additionally, the other additive may be made by blending inorganic powders, carbide powders and metallic salt powders. The inorganic powders, for example, can be metal oxide powders such as silica, aluminum oxide, titanium oxide, strontium titanate, cerium oxide, or magnesium oxide.

The agitator 37 is provided in the toner container 43. The agitator 37 includes an agitator shaft 47 that is rotatably supported by both sidewalls 201 of the developing frame 36, and an agitating member 48 that extends from the agitator shaft 47 in the direction perpendicular to the length direction of the agitator shaft 47. During the image formation, a driving force is transmitted from a motor (not shown in the drawings) to the agitator shaft 47 so that the agitating member 48 rotates and agitates the toner in the toner container 43.

The supplying roller 38 may be provided in the developing chamber 44 below the connection hole 45. The supplying roller 38 may include a metallic supplying roller shaft 49 that is rotatably supported by both sidewalls 201 of the developing frame 36, and a sponge roller 50 that is made of an electrically conductive sponge. The sponge roller 50 covers the supplying roller shaft 49. During the image formation, a driving force is transmitted from a motor (not shown in the drawings) so that the supplying roller 38 rotates and supplies the toner to the developer carrier 39.

The developer carrier 39 is arranged to the diagonally back bottom in the developing chamber 44, relative to the supplying roller 38. The developer carrier 39 includes a metallic developer carrier shaft 51 that is rotatably supported by the developing frame 36, and a rubber roller 52 that is made of electrically conductive rubber. The rubber roller 52 covers the developer carrier shaft 51.

The rubber roller 52 has a two-layer structure that includes a rubber roller layer and a coating layer. The rubber roller layer may be made of a conductive urethane rubber, a silicon rubber or EPDM rubber containing carbon microparticles, etc. The coating layer is coated on the surface of the rubber roller layer. The main component for the coating layer may be urethane rubber, a urethane resin, or a polyimide resin.

The rubber roller 52 and the sponge roller 50 of the developer carrier 39 are pressed against each other. In addition, the developer carrier 39 is arranged so that the developer carrier 39 is exposed downwardly from the opening 41 of the developing chamber 44.

During image formation, a driving force is transmitted from a motor (not shown in the drawings) so that the developer carrier 39 rotates. A developing bias is applied to the developer carrier 39 during the image formation.

The layer thickness limiting blade 40 is arranged so that the layer thickness limiting blade 40 presses the developer carrier 39 from above in the developing chamber 44. The layer thickness limiting blade 40 includes a blade 53 and a pressing portion 54.

The blade 53 may be formed of a metal plate spring member. The pressing portion 54 may include a semi-circular cross-section that is provided on the unattached end of the blade 53. The pressing portion 54 is made of insulating silicone rubber.

The anchored end of the blade 53 is fastened to the partition 42 by a fastening member 55. The pressing portion 54 provided on the unattached end of the blade 53 is pressed against the rubber roller 52 of the developer carrier 39.

(3-2-3) Developing Operation at the Processing Portion

At each of the developing cartridges 27, the respective colored toner moves from the toner container 43 to the connection hole 45 by its own weight. While agitated by the agitator 37, the toner is discharged from the connection hole 45 to the developing chamber 44.

The toner in the developing chamber 44 is supplied to the developer carrier 39 by the rotation of the supplying roller 38. At that time, a positive electrical charge is generated by the rotation the supplying roller 38 and the developer carrier 39 (where the developing bias is applied) and resulting friction between them.

The toner supplied to the developer carrier 39 enters between the pressing portion 54 and the rubber roller 52 along with the rotation of the developer carrier 39. A thin layer of the toner (with a relatively constant thickness) is formed on the surface of the rubber roller 52 after the toner passes between the pressing portion 54 and the rubber roller 52.

On the other hand, in each of the drum subunits 28 corresponding to each of developing cartridges 27, the scorotron-type charger 30 generates a corona discharge and charges the surface of the image carrier 29 uniformly with a positive charge during the rotation of the image carrier 29.

Next, the surface of the image carrier 29 is exposed by the laser beam from the scanner 20. Therefore, an electrostatic latent image is formed on the surface of the image carrier 29.

When the image carrier 29 further rotates, the toner contacts and faces the image carrier 29 from the rotating developer carrier 39. The toner that is held on the surface of the developer carrier 39 is supplied to the electrostatic latent image that is formed on the surface of the image carrier 29. The electrostatic latent image of the image carrier 29 is developed to be a visible image on the surface of the image carrier 29 in each color.

After the above transfer of toner from the developer carrier 39, any toner not transferred to the image carrier 29 remains on the developer carrier 39. Also, the paper dust from the paper 3 that is attached on the image carrier 29 when transferring is collected by the cleaning brush 31.

(3-3) Transfer Portion

The transfer portion 22 is, as shown in FIG. 1, arranged in the main unit casing 2 above the paper feeder 4 and below the processing portion 21, along the front and back direction. The transfer portion 22 includes a driving roller 56, a driven roller 57, a feed belt 58, a transfer roller 59, and a cleaning portion 60.

The driving roller 56 and the driving roller 57 are arranged to face each other with an interval in the front and back direction. The driving roller 56 is arranged on the back side of the cyan drum subunit 28C. The driven roller 57 is arranged on the front side of the black drum subunit 28K.

The feed belt 58 may be an endless belt that may be made of a resin film such as a conductive polycarbonate or polyimide. The conductive polycarbonate or polyimide may include scattered conductive particles such as carbon. The feed belt 58 is extended between the driving roller 56 and the driven roller 57. In other examples, the feed belt 58 may be an intermediate image transfer belt used with the drum subunits 28 or a photosensitive belt that replaces the drum subunits 28.

During image formation, a driving force is transmitted from a motor to the driving roller 56 so that the driving roller 56 rotates. Then the driven roller 57 is driven so that the feed belt 58 circulates between the driving roller 56 and the driven roller 57. At the transferring position where the feed belt 58 contacts and faces the image carrier 29, the feed belt 58 moves in an opposite direction of rotation compared to the direction of rotation of the image carrier 29.

The transfer rollers 59 are arranged within the circulation of the feed belt 58. Each of the transfer rollers 59 is arranged so that each of the transfer rollers 59 and each of the image carriers 29 sandwiches the feed belt 58. Each of the transfer rollers 59 has a metal shaft covered with a conductive rubber roller. The transfer rollers 59. In addition, each of the transfer rollers 59 is arranged so that each of the transfer rollers 59 contacts and faces the feed belt 58. Each of the transfer rollers 59 rotates in the same direction as the moving direction of the feed belt 58. During the image formation, a transfer bias is applied to each of the transfer roller 59 from a high voltage source provided in the main unit casing 2.

The cleaning portion 60 is provided below an outer surface of the feed belt 58. The cleaning portion 60 includes a first cleaning roller 61, a second cleaning roller 62, a scraping blade 63, and toner storage 64.

The first cleaning roller 61 contacts a lower portion of the feed belt 58. An upper portion of the feed belt 58 (opposite the lower portion of the feed belt 58) contacts the image carrier 29 and the transfer roller 59. The first cleaning roller 61 rotates in the same direction as the moving direction of the lower portion of the feed belt 58. During the image formation, the first cleaning bias is applied to the first cleaning roller 61.

The second cleaning roller 62 is arranged so that second cleaning roller 62 contacts the bottom of the first cleaning roller 61. The second cleaning roller 62 is arranged so that second cleaning roller 62 rotates in the opposite direction from the rotation direction of the first cleaning roller 61. During the image formation, the second cleaning bias is applied to the second cleaning roller 62.

The scraping blade 63 is provided so that the scraping blade 63 contacts the bottom of the second cleaning roller 62.

The toner storage 64 is arranged below the first cleaning roller 61 and the second cleaning roller 62 so that toner storage 64 accumulates the toner dropped from the second cleaning roller 62.

The paper 3 fed by the paper feeder 4 is carried by the feed belt 58 from the front side to back side of the image forming device 1. Thus, the paper 3 passes through each of the transfer positions that corresponds to each of the drum subunits 28. While the paper 3 is being carried, the toner images in each color that are carried in the image carrier 29 of each of the drum subunits 28 are transferred to the paper 3. Therefore, a color image of the toner is formed on the paper 3.

In detail, first a black toner image is transferred from the surface of the image carrier 29 of the black drum subunit 28K onto the paper 3. Next, a yellow toner image is transferred the surface of the image carrier 29 of the yellow drum subunit 28Y overlapped onto the paper 3. Then, similarly a magenta toner image and the cyan toner image are transferred an overlapped onto the paper 3. Therefore, a color image is finally formed on the paper 3.

During the transfer operation, toner may accidentally attach to the surface of the feed belt 58 instead of the paper 3. This additional toner is removed at the cleaning portion 60. First, the toner is transferred from the surface of the feed belt 58 to the primary cleaning roller 61 by the primary cleaning bias. Then the toner is transferred to the secondary cleaning roller 62 by the secondary cleaning bias. Then, the toner is scraped from the secondary cleaning roller 62 by the scraping blade 63. The scraped toner falls from the secondary cleaning roller 62 and is accumulated in the toner storage 64.

It is appreciated that the use of an intermediate image transfer belt or a photosensitive belt will have a slightly different image formation process as is known in the art.

(3-4) Fixing Portion

The fixing portion 23 is arranged on the rear side of the cyan drum subunit 28C in the main unit casing 2. Here, a fixing portion 23 faces the transfer position where the image carrier 29 and the feed belt 58 come in contact in the front and back direction. The fixing portion 23 includes a heating roller 65 and pressing roller 66.

The heating roller 65 includes a metal tube on which a releasing layer is formed. A halogen lamp is built inside the metal tube along a length direction of the metal tube. The surface of the heating roller 65 is heated to the fixing temperature by the halogen lamp.

The pressing roller 66 is arranged below the heating roller 65 so that the pressing roller 66 faces the heating roller 65. The pressing roller 66 presses the bottom of heating roller 65.

The paper 3 with the color image of the toner is carried to the fixing portion 23. While the paper 3 passes between the heating roller 65 and the pressing roller 66, the paper 3 is heated so the toner on the paper 3 is fixed and the image formation on the paper 3 is completed.

(4) Paper Discharge Portion

At the paper discharge portion 6, the upstream edge of feed pathway 67 is adjacent to the fixing portion 23. The downstream edge of the feed pathway 67 is adjacent to the paper discharge tray 68. The feed pathway 67 is formed in an approximately U-shape when the feed pathway 67 is viewed from the side. The paper 3 is first fed towards the back, then is reversed and discharged to the front.

At the middle of the feed pathway 67, a feed roller 69, and a pair of pinch rollers 70 are provided. In addition, a pair of paper discharge rollers 71 is provided on the downstream edge of the feed pathway 67.

A paper discharge tray 68 is provided on the paper discharge portion 6. The paper discharge tray 68 is formed such that the top wall of the main unit casing 2 gradually descends from the front to the back so that the discharged paper 3 can be stacked on the paper discharge tray 68.

Conveyed from the fixing portion 23, the paper 3 is carried along the feed pathway 67 by the feed roller 69 and the pinch roller 70, and then is discharged on the paper discharge tray 68 by the paper discharge roller 71.

2. Drum Unit

Figure 3:
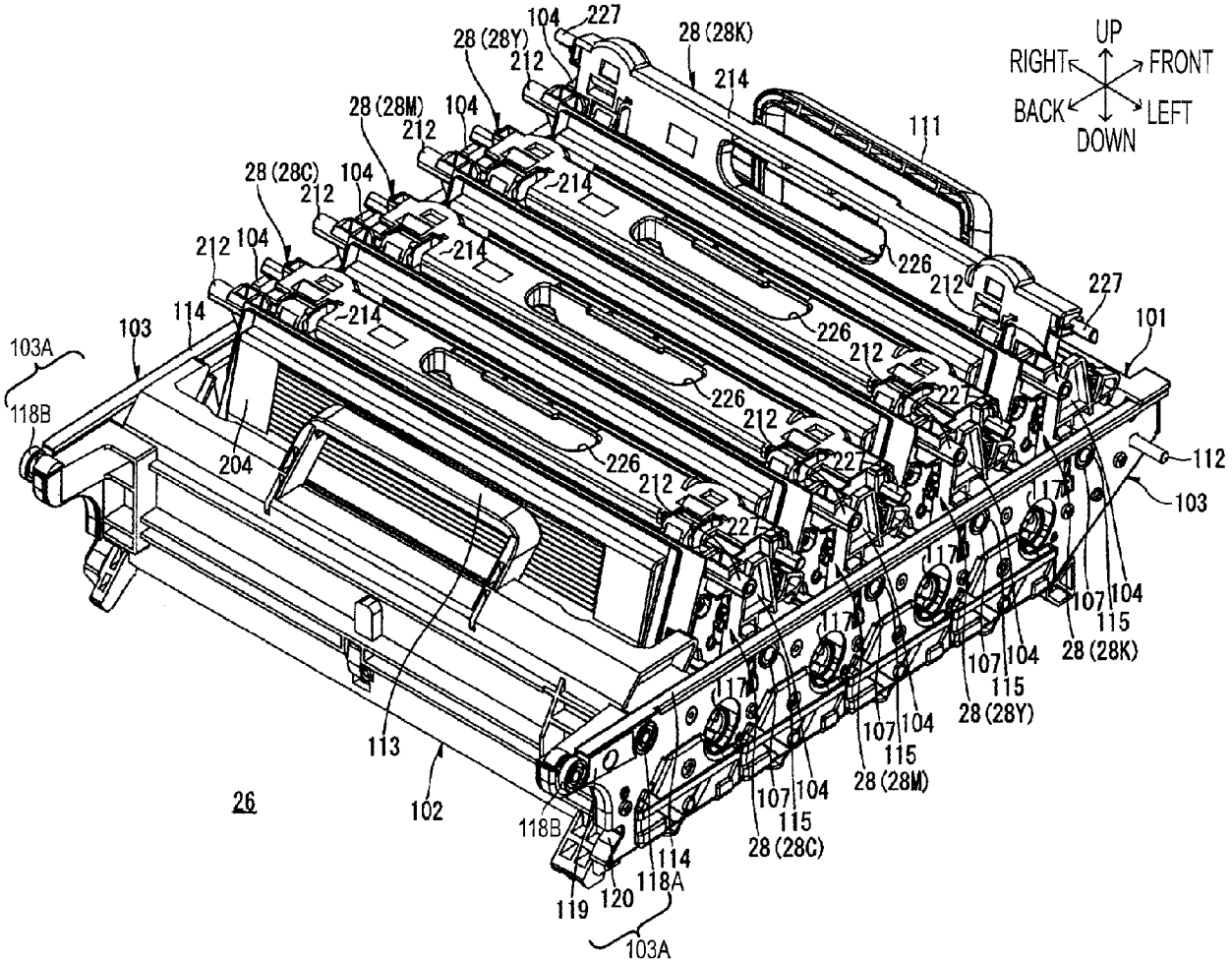
FIG. 3 shows a perspective view, which is viewed from the left rear top of the drum unit shown in FIG. 1, in accordance with aspects of the present invention.
Figure 4:
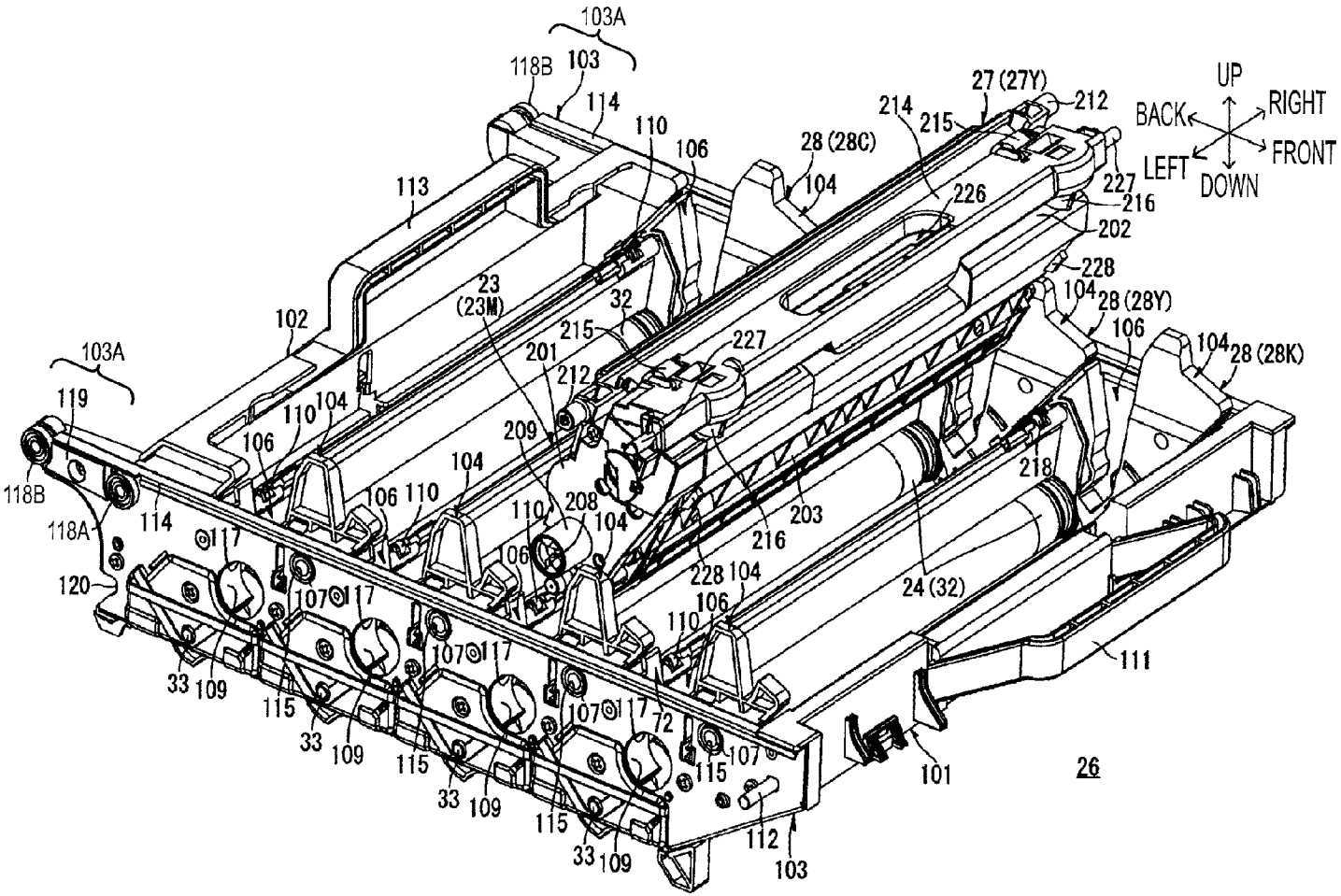
FIG. 4 shows a perspective view, which is viewed from the left front top, of the drum unit shown in FIG. 1, wherein one of the developing cartridges is in the middle of the inserting/removing, and other developing cartridges are removed, in accordance with aspects of the present invention.

FIG. 3 is a perspective view from the left rear top of the drum unit 26. FIG. 3 shows the four developing cartridges 27 are located in the drum unit 26. FIG. 4 is a perspective view from the left front top of the drum unit 26. FIG. 4 shows one of the developing cartridges 27 in the middle of the installation or removal process, while the other developing cartridges 27 have been removed from the drum unit 26.

Figure 5:
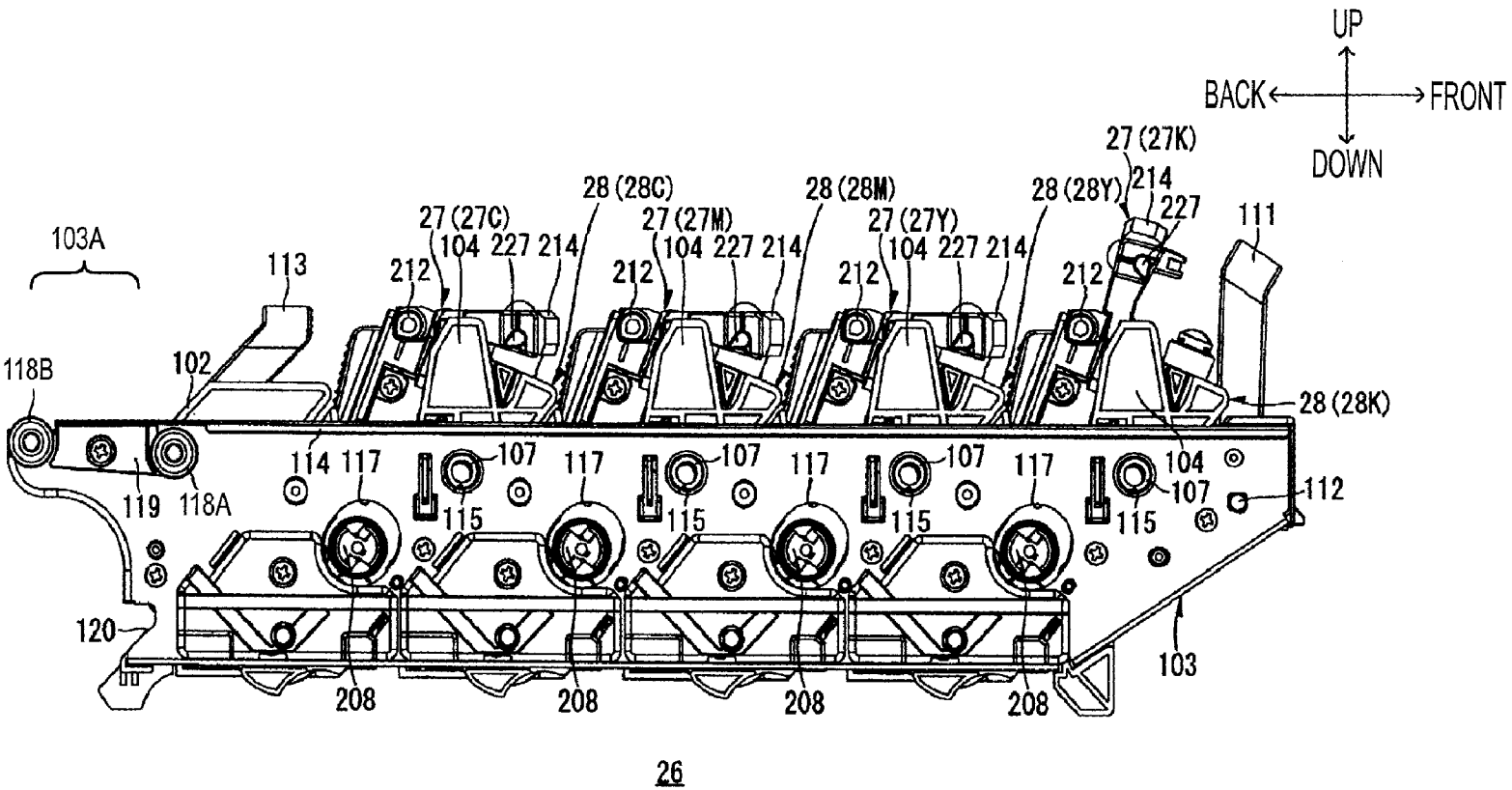
FIG. 5 shows a left lateral view of the drum unit shown in FIG. 1 in accordance with aspects of the present invention.

FIG. 5 is a left lateral view of the drum unit 26.

The drum unit 26 includes the four drum subunits 28, each of which corresponds to each color. The drum unit 26 further includes a front beam 101 and rear beam 102. The four drum subunits 28 are arranged in parallel between the front beam 101 and the rear beam 102 such that each drum subunit 28 extends in the same direction as the front beam 101 and the rear beam 102. The front beam 101 and the rear beam 102 extend along the left and right direction. A pair of side plates 103 sandwich the front beam 101, the four drum subunits 28 and the rear beam 102 from both sides in the width direction (left and right direction). The pair of side plates 103 extend along the front and back direction.

The drum unit 26 is formed with the front beam 101, the rear beam 102, and the pair of side plates 103 assembled all together. The drum unit 26 can be installed in and removed from the drum housing space 7 in the main unit casing 2 (see FIG. 1).

(1) Drum Subunit

As shown in FIG. 4, the drum subunit 28 includes a pair of side frames 104 that are arranged to face each other with an interval in the width direction, and a center frame 105 that is provided between both side frames 104 along the width direction (see FIG. 2).

Each of the side frames 104 may be formed of resin material in a flat plate shape.

A drum shaft 33 of the image carrier 29 is inserted through each of the side frames 104.

A guiding groove 106 is formed on each of the side frames 104. The guiding groove 106 guides the developing cartridge 27 during installation and removal with respect to the drum subunit 28. The guiding groove 106 is formed along approximately in the top and bottom direction from the rear top edge of the side frame 104 toward the front bottom edge of the side frame 104. The bottom edge of the guiding groove 106 is arranged so the developer carrier shaft 51 is at the position where the developer carrier 39 contacts the image carrier 29 when the developing cartridge 27 is installed in the drum subunit 28. The guiding groove 106 receives a collar member 205, which is attached at an end of the developer carrier shaft 205.

A boss 107 is formed on each of the side frames 104. The boss 107 is formed in a cylinder shape that externally projects in the width direction from the side frame 104. While the developing cartridge 27 is installed in the drum subunit 28, the boss 107 is arranged so that the boss 107 faces a window 206 of the developing cartridge 27 in the width direction.

A first insertion hole 109 is formed on the left side frame 104. The first insertion hole 109 faces a coupling gear 208 of the developing cartridge 27 when the developing cartridge 27 is installed in the drum subunit 28. The first insertion hole 109 is formed as a round hole that penetrates the left side frame 104 in its thickness direction.

The center frame 105 is formed of resin material. Supporting rollers 110 are provided on both ends of the top edge of the center frame 105 in the width direction. The support rollers 110 contact and support the developing cartridge 27 when the developing cartridge 27 is installed in the drum subunit 28. The supporting rollers 110 are rotatably supported by the rotary shaft (not shown in the drawings) that extends in the width direction along the top edge of the center frame 105.

(2) Front Beam

The front beam 101 is integrally formed of resin material. The front beam 101 is arranged at the front of the four drum subunits 28 that are arranged in parallel along the front and back direction. The front beam 101 also is installed between the pair of side plates 103.

The front beam 101 includes a front handle 111 that is provided at the center in the width direction, and a supporting shaft 112 that rotatably supports the front handle 111.

The front handle 111 is formed in an approximate U shape. At the center of the front beam 101 in the width direction. The front handle 101 is supported by the supporting shaft 102 so that an unattached end of the front handle 101 is rotatable about the supporting shaft 112. The front handle 101 can be positioned in a stowed position in which the unattached end of the front handle 111 stands along the front beam 101 (see FIG. 3). The front handle 101 can also be positioned in the operating position in which the unattached end of the front handle 111 inclines to the front side of the front beam 101 (see FIG. 4).

The supporting shaft 112 is supported by the front beam 101 so that the supporting shaft 102 penetrates the front beam 101 in the width direction. In addition, both edges in the width direction of the supporting shaft 112 externally project in the width direction from the front beam 101. In addition the both edges in the width direction of the supporting shaft 112 externally project in the width direction by penetrating the side plates 103.

(3) Rear Beam

The rear beam 102 is integrally formed of resin material. The rear beam 102 is arranged on the back side of the four drum subunits 28 that are arranged in parallel along the front and back direction. The rear beam 102 also is installed between the pair of side plates 103.

As shown in FIG. 3, the rear beam 102 is formed in an approximate U shape where the rear side is opened when viewed from the top. At the center of the rear beam 102 in the width direction, a rear handle 113 is integrally provided. The rear handle 113 has an approximate U shape when viewed from the back. An unattached end of the rear handle 103 is connected to the rear beam 102. The unattached end of the rear handle 103 inclines from the back bottom to the front top so that the rear handle 113 projects diagonally upwards from the rear beam 102.

(4) Side Plates

Each of the pair of side plates 103 may be formed of a material with a higher rigidity than the resin material that forms each of the drum subunits 28, front beam 101, and rear beam 102. The material of the metal with the higher rigidity may be, for example, metal or glass fiber reinforced resin, and/or preferably, a steel plate.

Each of the pair of side plates 103 is formed in an approximately narrow rectangular shape that extends in the front and back direction when viewed from the side. Each of the pair of side plates 103 is formed so that the front edge of the each of the pair of side plates 103 faces the front beam 101, and the rear edge of each of the pair of side plates 103 faces the rear beam 102. Each of the pair of side plates 103 is fixed to the front beam 101, the four drum subunits 28, and the rear beam 102, respectively.

At the top edge of each of the side plates 103, a flange 114 is formed along the front and back direction. The flange 114 is externally bent in the width direction so that the cross-section of each of the side plates 103 appears to be an L shape. The flange 114 linearly extends in the front and back (e.g., horizontal) direction.

At rear edge of each of the side plates 103, an extended portion 103A is formed in an approximate L shape in which the top edge of each of the side plates 103 extends beyond the rear beam 102, when viewed from the side. A front roller 118A and a rear roller 118B are rotatably provided in the extended portion 103A. The front roller 118A and a rear roller 118B are arranged in the front and back direction so that the front roller 118A and a rear roller 118B sandwich a spacer 119 therebetween. The front roller 118A is arranged below the flange 114, and the rear roller 118B is arranged behind the rear edge of the flange 114.

In addition, a notch 120, which is an approximate U shape cut on the rear edge when viewed from the side, is formed on the rear edge of each side plate 103. When the drum unit 26 is installed in the main unit casing 2, an alignment shaft (not shown in the drawings) that is provided in the main unit casing 2 fits on the notch 120 so that the drum unit 26 is aligned relative to the main unit casing 2.

Four light transmission holes 115 accept the bosses 107 of each of the drum subunits 28. The four light transmission holes 115 are formed on the top edge of each side plate 103 along the front and back direction at intervals. These light transmission holes 115 are formed in a round shape so that the transmission holes 115 penetrate each side plate 103 in the thickness direction at a position that faces the bosses 107 of each drum subunit 28. The boss 107 of each drum subunit 28 fits in each light transmission hole 115 so that each boss 107 is externally exposed in the width direction. Therefore, the rotational movement of each drum subunit 28 about the drum shaft 33 relative to each side plate 103 is restricted.

A shaft hole 116 is formed at the bottom edge of each side plate 103. The edge of each drum shaft 33 in the axis direction is inserted into the shaft hole 116.

Four second insertion holes 117 are formed on the left side plate 103. Each of the second insertion holes 117 faces the coupling gear 208 of the developing cartridge 27 in the width direction when the developing cartridge 27 is installed in the drum subunit 28. Each of four second insertion holes 117 is formed at the center of the side plates 103 in the top and bottom direction. The four second insertion holes 117 are arranged along the front and back direction. Each of four second insertion holes 117 is formed in a round shape. Each of four second insertion holes 117 penetrates the left side plate 103 in the thickness direction. The four second insertion holes 117 are located at a position where each of four second insertion holes 117 face each of the first insertion holes 109 corresponding to each drum subunit 28 in the width direction.

3. Developing Cartridge

Figure 6:
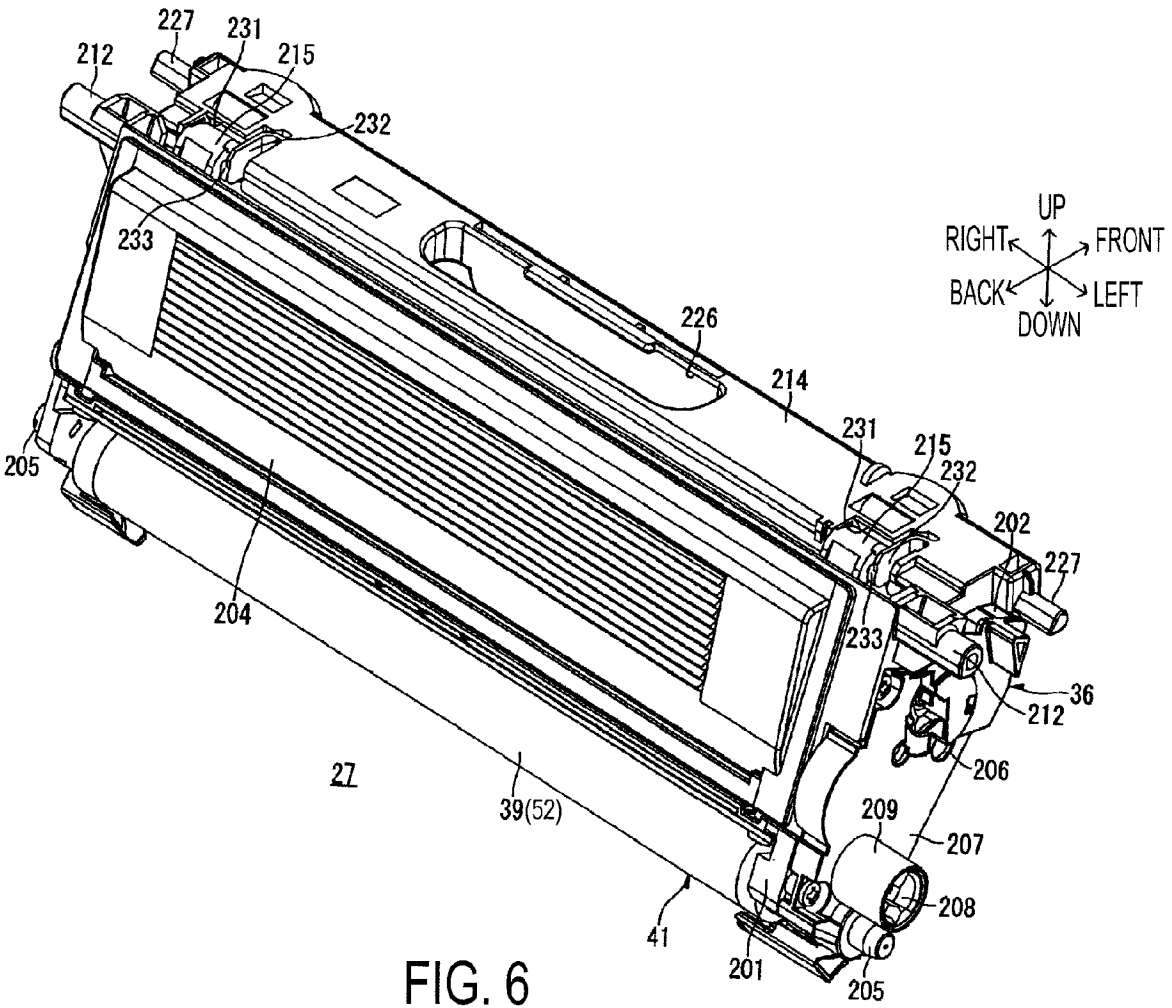
FIG. 6 shows a perspective view of the developing cartridge shown in FIG. 1 viewed from the rear left, the handle being in an inclined condition, in accordance with aspects of the present invention.
Figure 7:
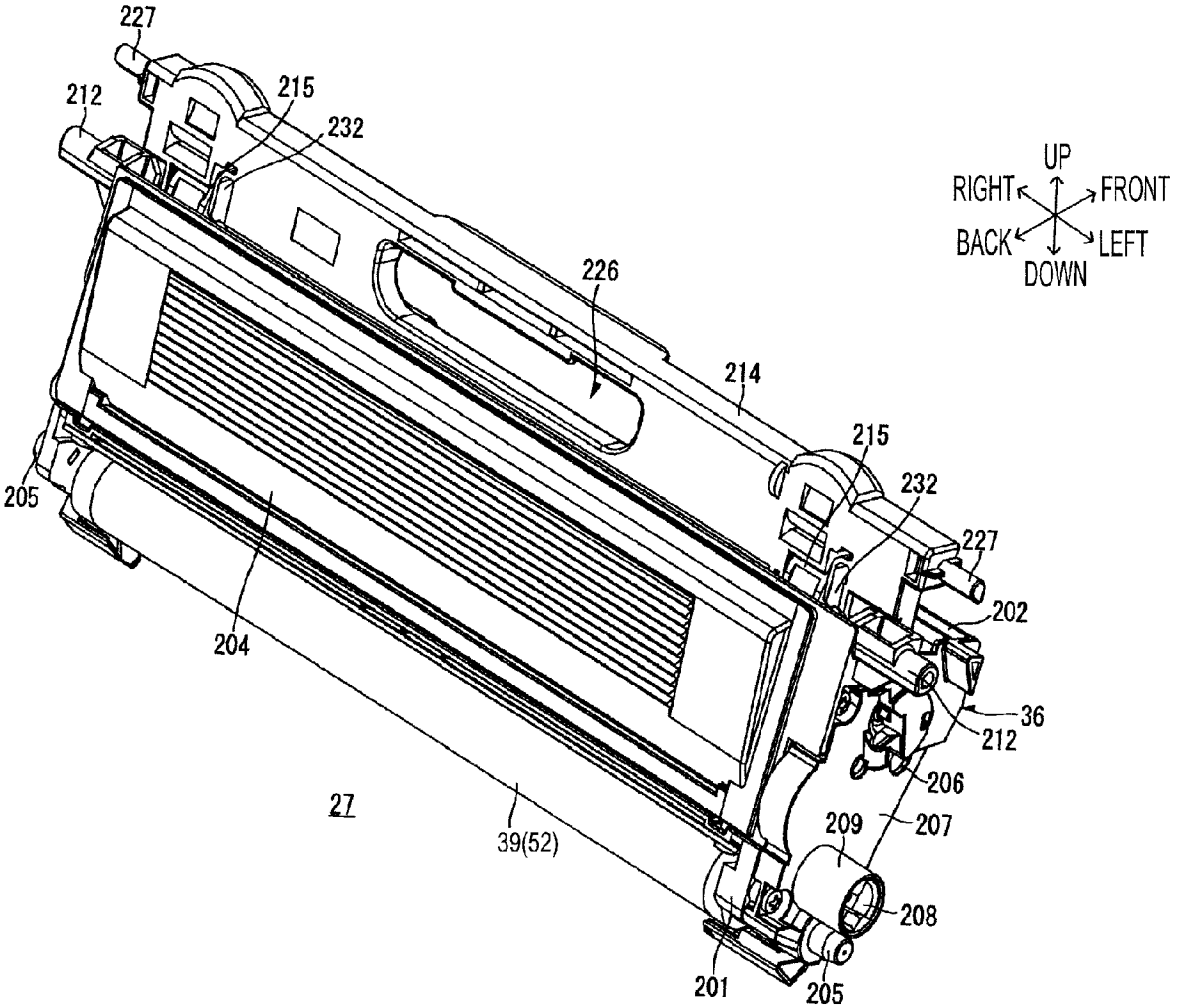
FIG. 7 shows a perspective view of the developing cartridge shown in FIG. 1 viewed from the rear left, the handle being in a standing condition, in accordance with aspects of the present invention.
Figure 8:
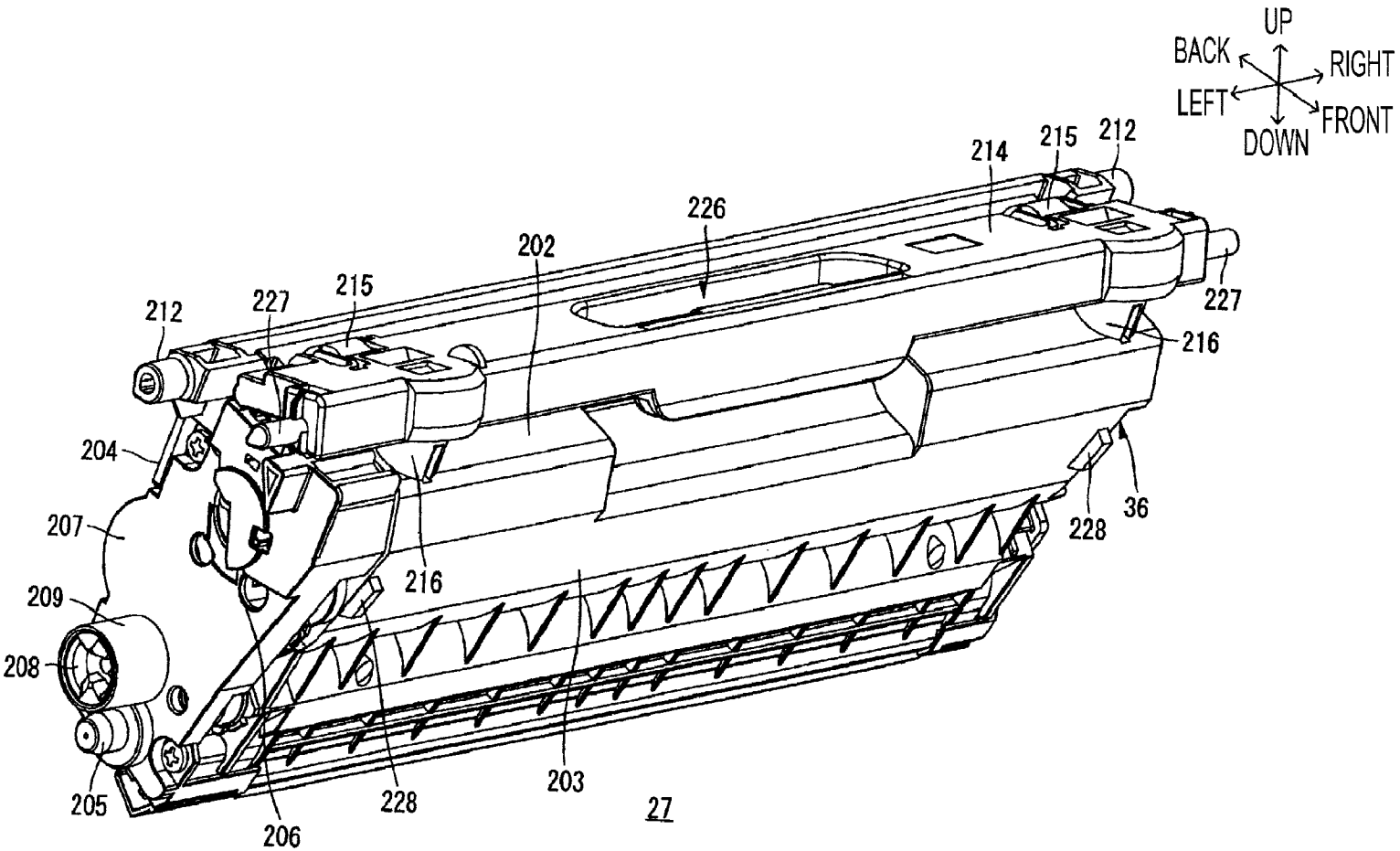
FIG. 8 shows a perspective view of the developing cartridge shown in FIG. 1 viewed from the front left, the handle being in an inclined condition, in accordance with aspects of the present invention.
Figure 9:
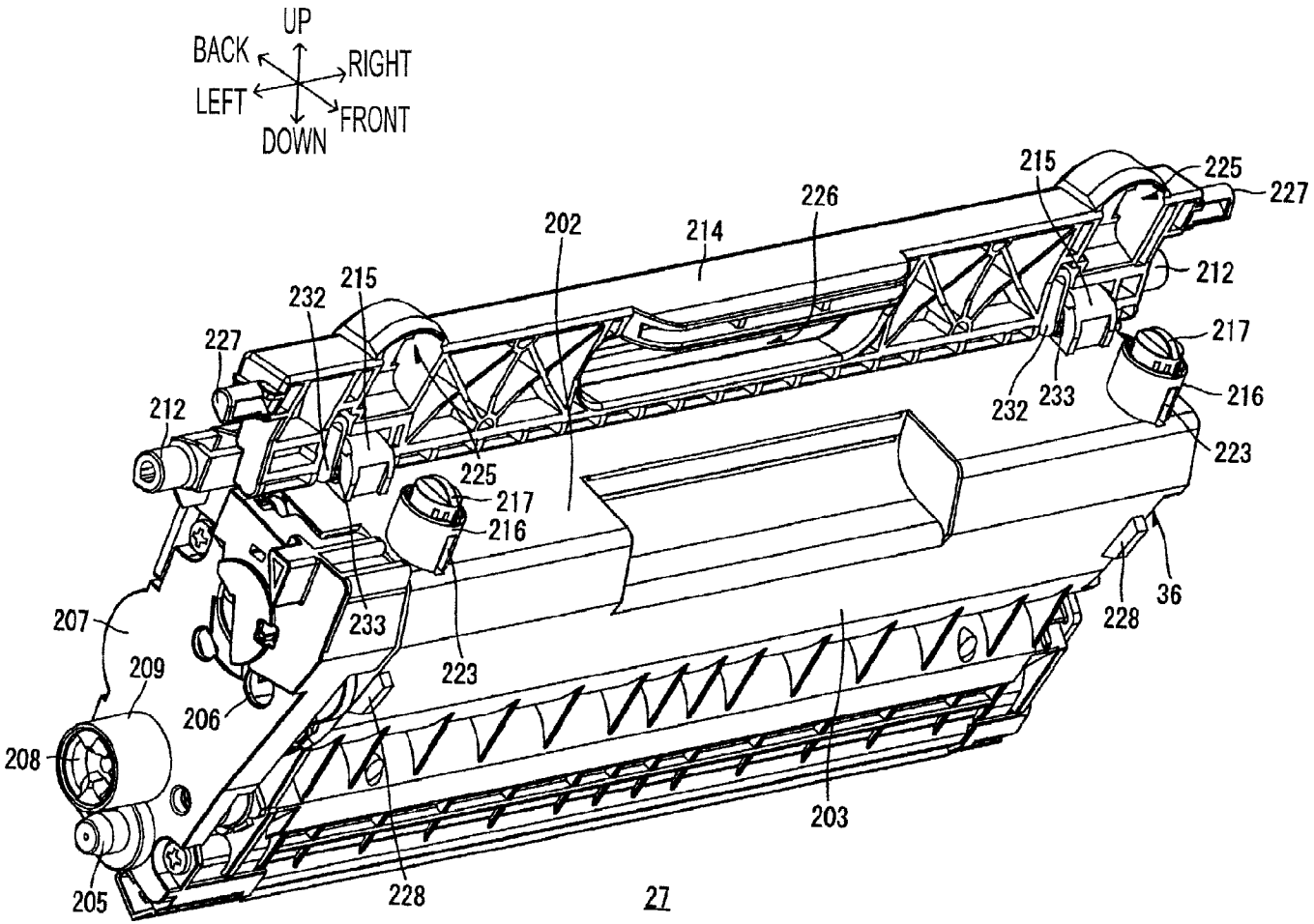
FIG. 9 shows a perspective view of the developing cartridge shown in FIG. 1 viewed from the front left, the handle being in a standing condition, in accordance with aspects of the present invention.
Figure 10:
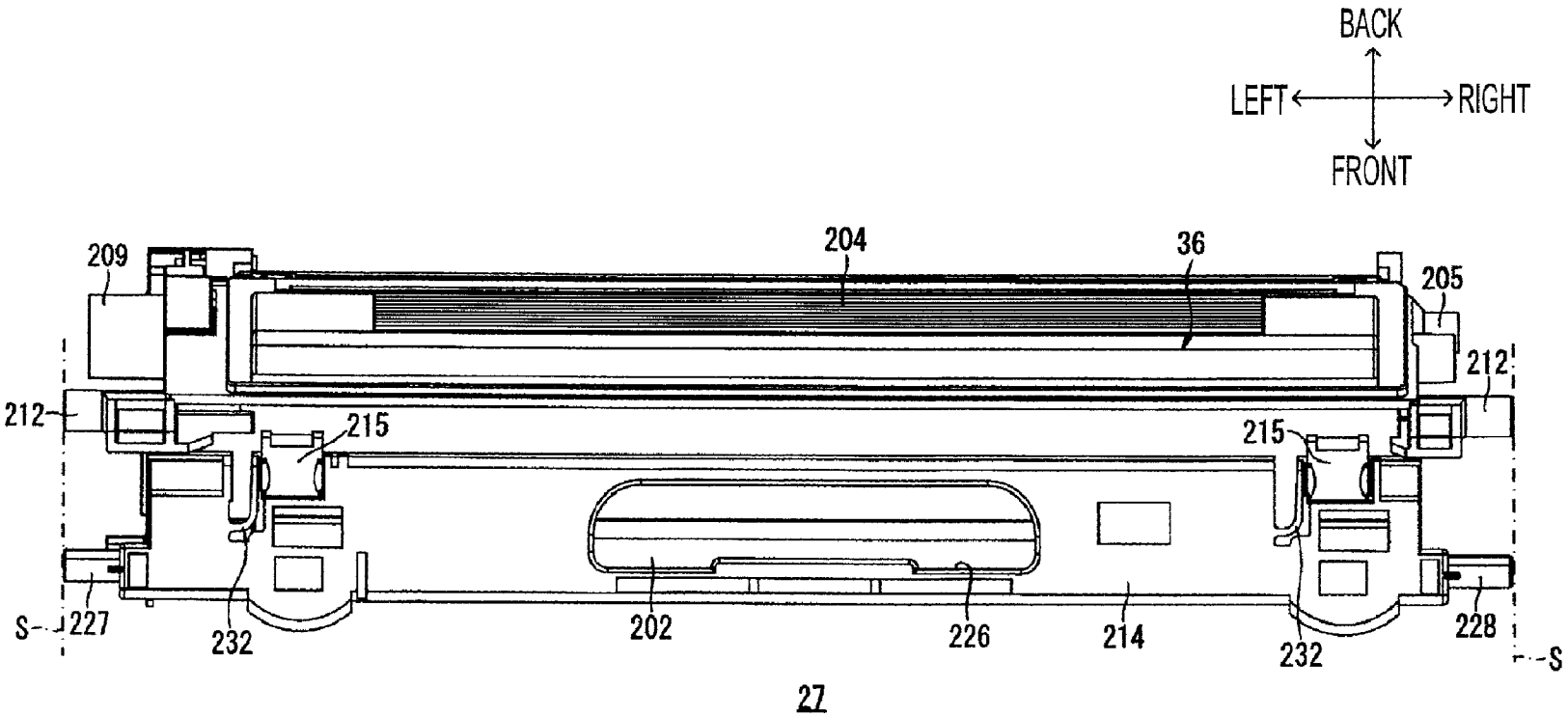
FIG. 10 shows a plane view of the developing cartridge shown in FIG. 1 in accordance with aspects of the present invention.
Figure 11:
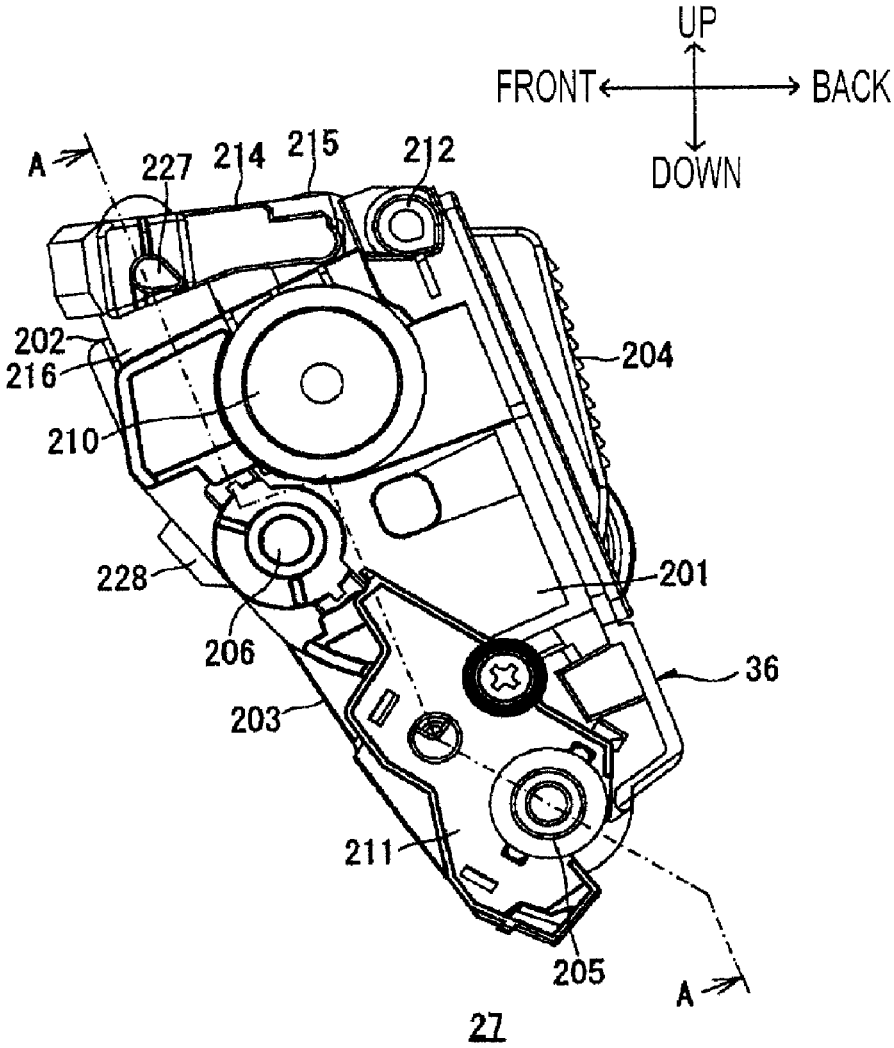
FIG. 11 shows a right lateral view of the developing cartridge shown in FIG. 1 in accordance with aspects of the present invention.
Figure 12:
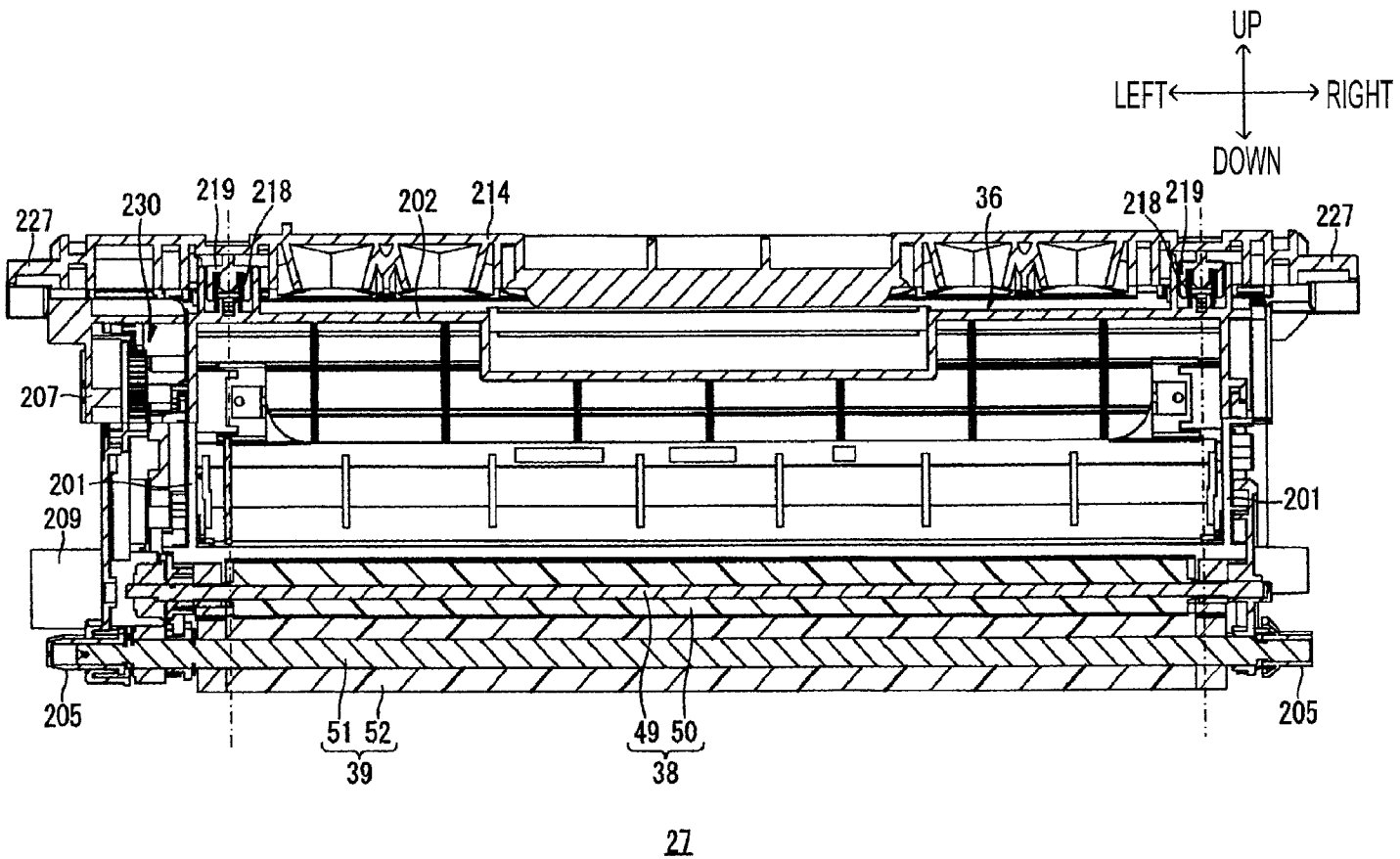
FIG. 12 shows a cross-sectional view of the developing cartridge, which is cut along the cutting line A-A in FIG. 11, in accordance with aspects of the present invention.
Figure 13:
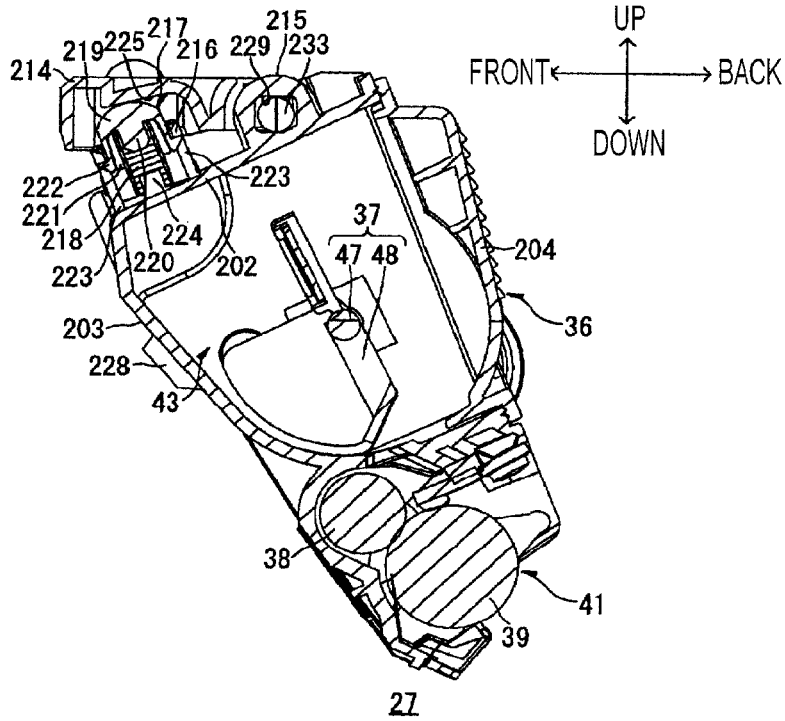
FIG. 13 shows a right lateral view of the developing cartridge shown in FIG. 1, the handle being in an inclined condition, in accordance with aspects of the present invention.
Figure 14:
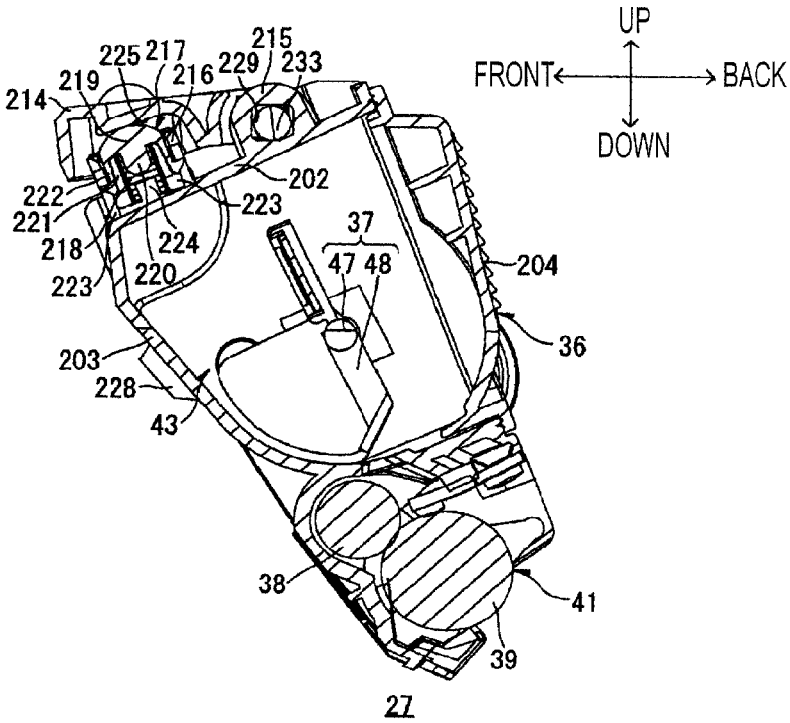
FIG. 14 shows a right lateral view of the developing cartridge shown in FIG. 1, the handle being in a pressing condition, in accordance with aspects of the present invention.

FIGS. 6 and 7 are perspective views of the developing cartridge 27 viewed from the rear left. FIGS. 8 and 9 are perspective views of the developing cartridge 27 viewed from the front left. FIG. 10 is a plan view of the developing cartridge 27. FIG. 11 is a right lateral view of the developing cartridge 27. FIG. 12 is a cross-sectional view that is cut along the cutting line A-A in FIG. 11. Furthermore, FIGS. 13 and 14 are right lateral cross-sectional views of the developing cartridge 27. In FIGS. 13 and 14, the supplying roller 38 and developer carrier 39 are simplified.

(1) Developing Cartridge

The developing frame 36 of the developing cartridge 27 includes a pair of sidewalls 201 (facing each other in the width direction), a top wall 202 (between the top edges of both sidewalls 201), a front wall 203 (between the front edges of both sidewalls 201), and a rear wall 204 (between the rear edges of both sidewalls 201). An opening 41 exposing the developer carrier 39 is formed at the bottom edges of both sidewalls 201, front wall 203 and the rear wall 204.

The window 206 is formed in each sidewall 201. The window 206 is used for detecting the amount of toner contained in the toner container 43. These windows 206 are arranged to face each other over the toner container 43. In order to detect the amount of toner, the windows 206 let light transmit through in the width direction.

A gear mechanism (covered by a gear cover 207) is provided on the left sidewall 201 as shown in FIGS. 6-9. The gear mechanism includes the coupling gear 208 exposed from the gear cover 207, and a gear train 230 that engages with the coupling gear 208 inside the gear cover 207 (see FIG. 12).

A cylinder-shaped gear array 209 externally projects in the width direction at the bottom edge of the gear cover 207. The coupling gear 208 is arranged in the gear array 209. The coupling gear 208 is exposed from the tip of the gear array 209.

A coupling shaft (not shown in the drawings) is provided in the main unit casing 2. The coupling shaft is connected to the coupling gear 208 during the image formation so that the coupling shaft can move forward and backward. The coupling shaft transmits the driving force of the motor to the coupling gear 208.

The gear train 230 includes an agitator driving gear (fixed on the rotary shaft 47 of the agitator 37), a supplying roller driving gear (fixed on the supplying roller shaft 49 of the supplying roller 38), and a developer carrier driving gear (fixed on the developer carrier shaft 51 of the developer carrier 39). The agitator driving gear, the supplying roller driving gear and the developer carrier driving gear are directly or indirectly coupled with the coupling gear 208. Thus, the driving force applied to the coupling gear 208 is transmitted to the agitator 37, the supplying roller 38, and the developer carrier 39 via the gear train 230.

As shown in FIG. 11, on the right sidewall 201, a cap 210 that closes the toner filling opening (not shown in the drawings) for filling the toner into the toner container 43 is provided above the window 206.

In addition, a bearing 211 is provided at the bottom edge of the right sidewall 201. The bearing 211 rotatably supports the right edge of the developer carrier shaft 51. As shown in FIG. 12, while the right edge of the developer carrier shaft 51 is supported by the bearing 211 in a rotatable manner, the left edge of the developer carrier shaft 51 is inserted into the left sidewall 201 in a rotatable manner. Thus, the developer carrier shaft 51 is rotatably supported by the developing frame 36.

The left edge of the developer carrier shaft 51 externally projects in the width direction from the gear cover 207. The right edge of the developer carrier shaft 51 externally projects in the width direction from the bearing 211. The collar member 205 covers each of the projected portions of the developer carrier shaft 51.

In addition, as shown in FIGS. 6-9, a releasing projection 212 is formed at the joint of the top edge of the rear wall 204 with the top edge of both sidewalls 201. The releasing projection 212 is formed in an approximate cylinder shape, and externally projects in the width direction.

A handle 214 is provided on the top wall 202 of the developing cartridge 27. The handle 214 can be grasped when the developing cartridge 27 is installed in or removed from the drum subunit 28. The handle 214 is formed in a thin plate shape that extends in the width direction. The handle 214 is pivotally provided between a standing condition, an inclined condition, and a pressed condition. In the standing condition, the handle 214 stands approximately perpendicular to the top wall 202 (see FIGS. 7 and 9). In the inclined condition, the handle 214 is forwardly inclined from the standing condition and is closer to the top wall 202 (see FIGS. 6, 8 and 13). In the pressed condition, the handle 214 is closer to the top wall 202 than in the inclined condition (See FIG. 14).

More specifically, as shown in FIGS. 13 and 14, a handle support 215 is integrally formed on both edges of the top wall 202 in the width direction at the rear edge of the top wall 202. The handle support 215 projects upwardly from the top wall 202. The handle support 215 may be formed in a semicircular shape when viewed from the side. A through hole 229 that penetrates the handle support 215 in the width direction is formed on the handle support 215. As shown in FIGS. 6 and 7, notches 231 are formed on the common edge in the width direction at the rear edge of the handle 214. The handle support 215 can fit into notches 231. An elastic deforming portion 232 (in an approximate L shape when viewed from the top) is arranged on each of the notches 231. The anchored edge of the elastic deforming portion 232 is connected to the left side surface of each of the notches 231. The unattached end of the elastic deforming portion 232 faces the right side of the notch 231 with an interval in the width direction. The handle support 215 fits between the unattached end of the elastic deforming portion 232 and the right side of the notch 231. A pair of supporting shafts 233 are provided so that one of the supporting shafts 233 projects from the unattached end of the elastic deforming portion 232 toward the right side of the notch 231. The other one of the supporting shaft 233 projects from the right side of the notch 231 toward the unattached end of the elastic deforming portion 232. Therefore, the handle 214 is attached to the handle support 215. The handle support 215 fits into each of the notches 231 in a way that a space between the pair of the supporting shafts 233 is first widened by deforming the elastic deforming portion 232. The deformation of the elastic deforming portion 232 is released to place each supporting shaft 233 into the through hole 229 of the handle support 215.

In addition, as shown in FIGS. 9-12, a spring guiding member 216 is formed on the front edge of the top wall 202 at both edges in the width direction, which is axis direction of the developer carrier 39, with an interval that is approximately the same as the length in the width direction of the rubber roller 52 of the developer carrier 39. Each of the spring guiding members 216 face each of the handle supports 215 with a gap in the front and back direction. Each of the spring guiding members 216 opposes each edge of the rubber roller 52 in the width direction. Furthermore, as shown in FIGS. 13 and 14, a contacting member 217 and a coil spring 218 are provided inside each of the spring guiding members 216. The contacting member 217 is positioned above the coil spring 218 so that the contacting member 217 can move upwardly and downwardly in accordance with a pressing force of the coil spring 218.

The contacting member 217 includes a main body 219 (having a convex curved top in an approximately circular shape when viewed from above), a boss 220 (projecting downwardly from the center of the bottom of the main body 219), and a cylindrical extension 221 (extending towards the inner circumference of the spring guiding member 216 from the periphery of the bottom surface of the main body 219). The main body 219, the boss 220, and the cylindrical extension 221 may be integrally molded. A plurality of latching tabs 222 are formed on the cylindrical extension 221. Each of the latching tabs 222 is fit in a groove 223 formed on the spring guiding member 216. A tip of the each latching tab 222 latches the top edge of the groove 223 so that the contacting member 217 does not come off the spring guiding member 216.

The coil spring 218 is provided in a compressed manner between the contacting member 217 and the top wall 202. A spring attaching boss 224 is formed on the top wall 202. The spring attaching boss 224 is surrounded by the spring guiding member 216. The spring attaching boss 224 is inserted into the bottom edge of the coil spring 218. The boss 220 of the contacting member 217 also is inserted at the top edge of the coil spring 218. Of course, the top of contacting member 217 may have any shape as desired to contact various surfaces. Further, the extension 221 and spring attaching boss 224 may have any desired shape as well and are not limited to cylinders.

As shown in FIG. 9, a concave portion 225 is formed on the bottom surface of the handle 214, which faces the top wall 202. The concave portion 225 faces each of the contacting members 217 so that the concave portion 225 can accept the corresponding contacting member 217 when the handle 214 is in the inclined condition and the pressed condition. When the handle 214 is in the inclined condition, each of the contact members 217 is received in each of the concave portions 225 such that the tip of each contacting member 217 contacts the floor of each concave portion 225, which is the bottom of the handle 214.

As shown in FIG. 10, a through hole 226 is formed at the center in the width direction on the handle 214 in an approximate rectangular shape when viewed from the top. A length of the through hole in the width direction is longer than a length in the front and back direction. Thus, the handle 214 can be easily grasped by inserting fingers in the through hole 226.

In addition, a pressing projection 227 is formed in each edge on the front edge of the handle 214 in the width direction. The pressing projection 227 is formed in an approximate column shape when viewed from the side. The pressing projection 227 externally projects in the width direction from the handle 214. As shown in FIG. 10, each pressing projection 227 is formed in a length so that the edge of the each pressing projection 217 is positioned on a plane S that includes the edge of the releasing projection 212 that projects on the same side. In other words, the tip of each pressing projection 227 is positioned in the same plane as the tip of the releasing projection 212. Furthermore, as shown in FIG. 11, the edge of each pressing projection 227 is positioned in a lower position than the edge of the releasing projection 212 when the developing cartridge 27 is installed in the drum subunit 28 and the handle 214 is positioned in the inclined condition.

As shown in FIGS. 8 and 9, a supported projection 228 is formed in each edge of the front wall 203 in the width direction. The supported projection 228 is in an approximate trapezoid shape when viewed from the side. The supported projection 228 forwardly projects from the front wall 203.

The pressing projections 227 are used to allow a pressing force to press developer carrier 39 against image carrier 29.

The description of the pressing projections 227 being on an opposite side, opposite end, or opposite edge from the developer carrier (or developer carrier support) is intended to be expansive in definition. Specifically, the opposite edge (or end or side) can be across the width or the length or any line passing through the developing cartridge 27. Further, the description that any projection (including pressing projections 227) is "near" an edge, side, or end is intended to be relativistic to the location of another element (for instance, the developer carrier 39 or developer carrier support). For example, a pressing projection 227 near an end opposite a developer carrier 39 means that the pressing projection 227 is closer to the end than the developer carrier 39. Something being "near" means it is closer than another element.

(2) Installation and Removal of the Developing Cartridge with Respect to the Drum Unit First, a user can grasp the handle 214 by inserting fingers in the through hole 226 of the handle 214 as shown in FIG. 4. Then the developing cartridges 27 can be installed in the corresponding drum subunit 28 from the top of the drum unit 26.

More specifically, first, the collar members 205 of the developing cartridge 27 are inserted in the guiding groove 106 of each side frame 104 of the corresponding drum subunit 28. Then the developing cartridge 27 is pushed downwardly toward the drum subunit 28 along the guiding groove 106. When the developer carrier 39 contacts the image carrier 29, the developing cartridge 27 is not allowed to be pushed further. Then, due to the weight of the developing cartridge 27, the top edge of the developing cartridge 27 inclines about the roller shaft 51 in the direction toward the front center frame 105. Then the supported projection 228 comes into contact with the supporting roller 110. Thus, the developing cartridge 27 is aligned with respect to the drum subunit 28, and the installation of the developing cartridge 27 to the drum subunit 28 is completed.

After the developing cartridge 27 is installed as described above, when a hand is released from the handle 214, which may be in a standing position, the handle 214 pivots about the supporting shaft 233 from the standing condition to the inclined condition by the handle 214's own weight.

When each of the developing cartridges 27 is installed in each of the drum subunits 28 respectively, as shown in FIG. 3, the front handle 111 of the front beam 101, the handle 214 of each of the developing cartridges 27 and the rear handle 113 of the rear beam 102 are arranged in substantially overlapped along the front and back direction.

Under the condition that the developing cartridge 27 is installed in the drum subunit 28, the handle 214 can be grasped so that the handle 214 is pulled up from the inclined condition to the standing condition. Then the developing cartridge 27 can be removed from the drum unit 26 by further pulling upwardly.

4. Rail and Releasing/Pressing Mechanism

Figure 15:
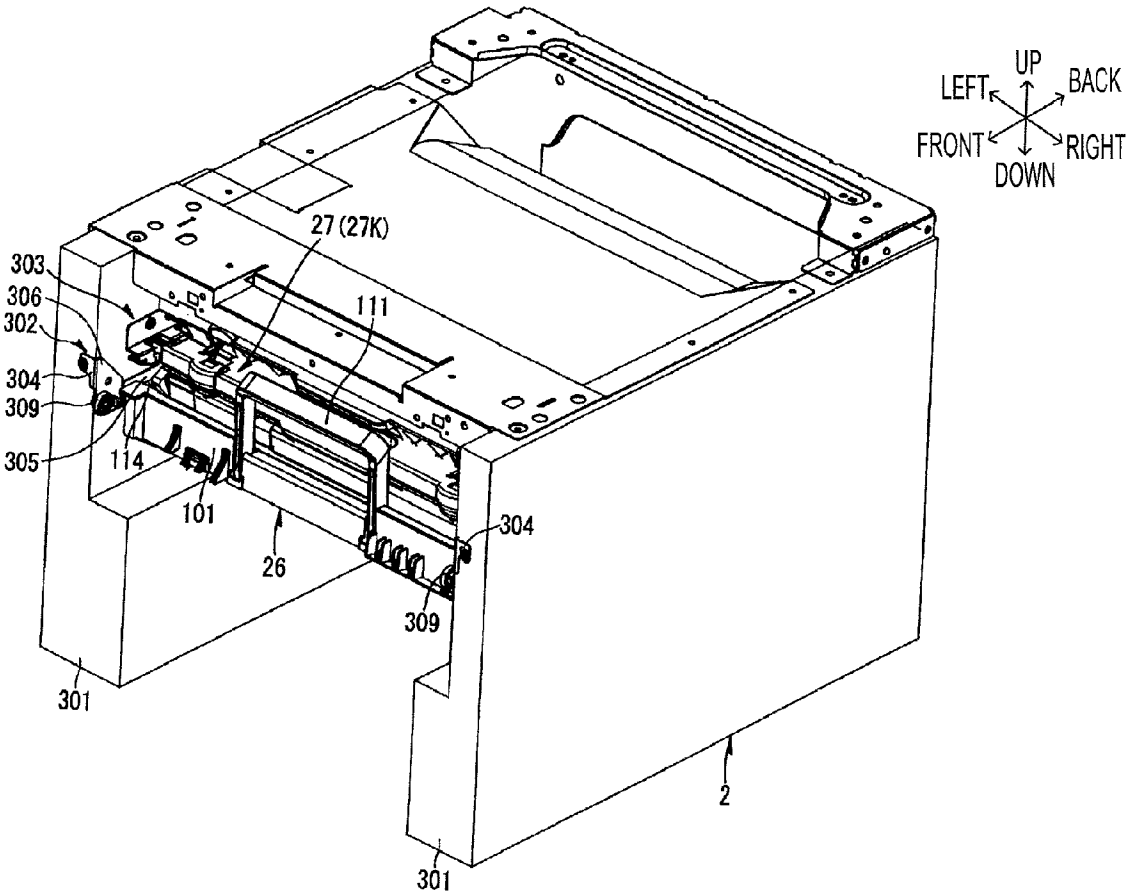
FIG. 15 shows a perspective view of the main unit casing and the drum unit that are shown in FIG. 1 viewed from the right front top in accordance with aspects of the present invention.

FIG. 15 is a perspective view of the main unit casing 2 and the drum unit 26 viewed from the right front top. FIG. 15 shows the condition in which the exterior panel and the front cover 9 of the main unit casing 2 are removed and the drum unit 26 is installed in the main unit casing 2.

The main unit casing 2 includes a pair of body frames 301 that are arranged to face each other in the width direction over the drum unit 26. On an internal surface of each of the body frames 301, there are a left rail 302 and a right rail 302, respectively. Each of these rails 302 guides the drum unit 26 when the drum unit 26 is installed in or removed from the main unit casing 2. A releasing/pressing mechanism 303 is also on the internal surface of each of the body frames 301. The releasing/pressing mechanism 303 releases or presses the developer carrier 39 of the developing cartridge 27 with respect to the image carrier 29 when the developing cartridge 27 is installed in the drum subunit 28.

In FIG. 15, only the left side detaching/pressing mechanism 303 is shown.

Figure 16:
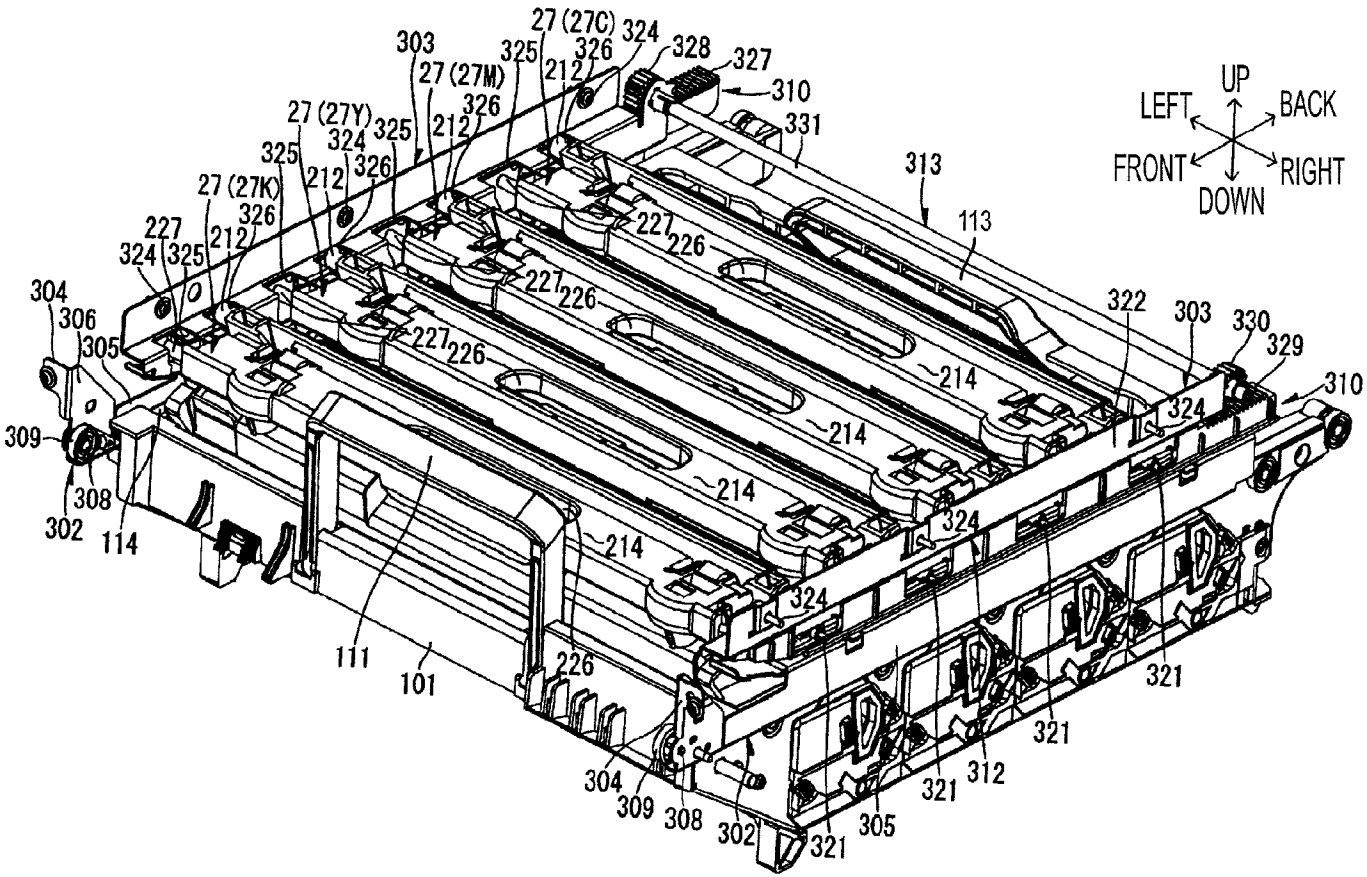
FIG. 16 shows a perspective view of the drum unit, left and right rails, and releasing/pressing mechanism that are shown in FIG. 15 viewed from the right front top in accordance with aspects of the present invention.
Figure 17:
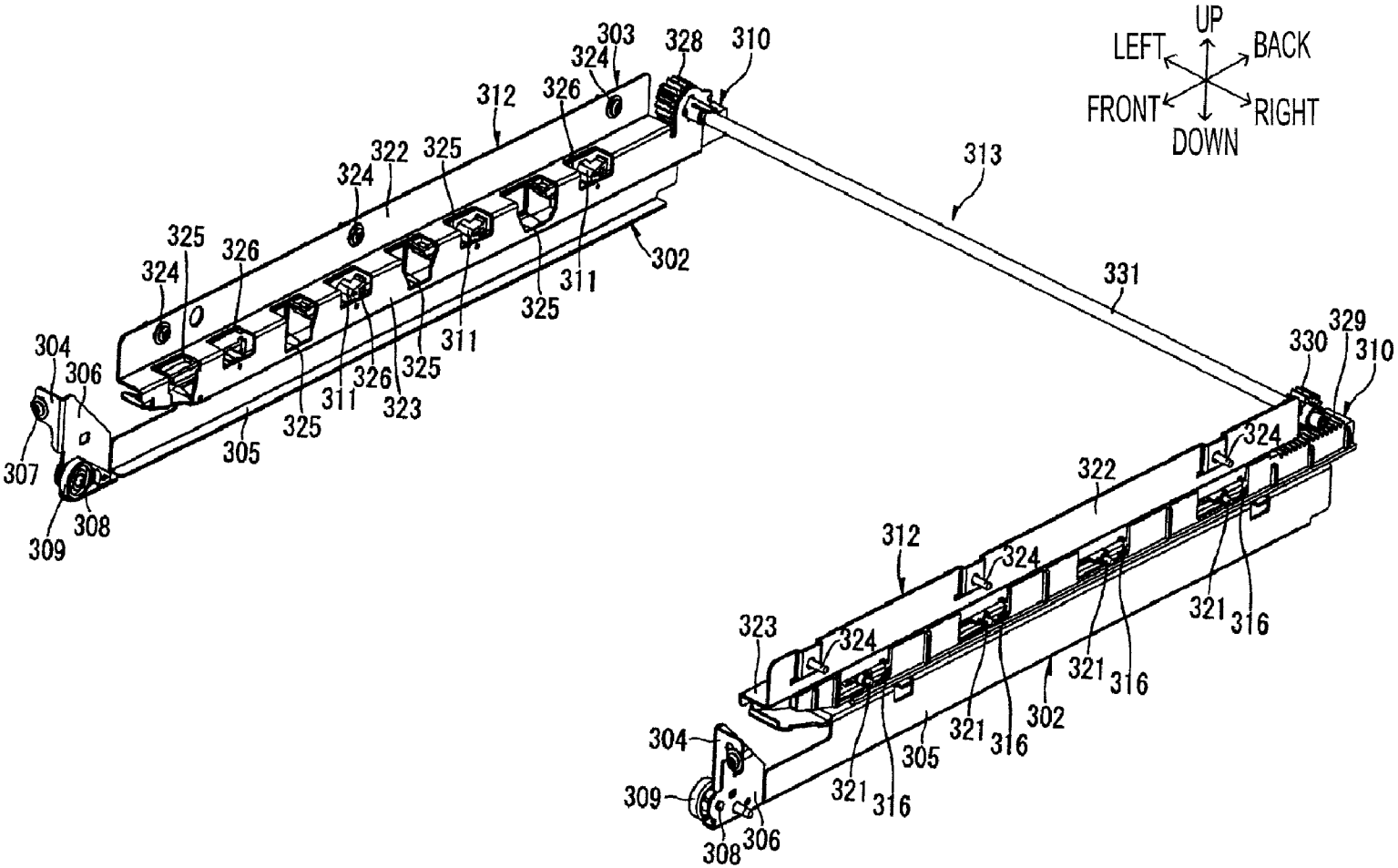
FIG. 17 shows a perspective view of the rail and releasing/pressing mechanism that are shown in FIG. 16 viewed from the right front top in accordance with aspects of the present invention.

FIG. 16 is a perspective view of the drum unit 26, left and right rails 302, and the releasing/pressing mechanism 303 viewed from the right front top. In addition, FIG. 17 is a perspective view of the left and right rails 302 and the releasing/pressing mechanism 303 viewed from the right front top.

(1) Rails

The left rail 302 and the right rail 302 are arranged to face each other in the width direction over the drum unit 26. Each of the rails 302 includes a rail fixing portion 304 that are arranged to face each other on the front edge surface of the body frame 301, a rail body 305 that extends along the front and back (horizontal) direction in the body frame 301, and a joint 306 that connects the rail fixing portion 304 and the rail body 305 together.

The rail fixing portion 304 is fixed on the front edge surface of the body frame 301 with a screw 307.

The rail body 305 is formed in an approximate L shape in a cross-sectional view by bending a bottom edge of the rail body 305 inwardly in the width direction. When the drum unit 26 is installed in the main unit casing 2, the flange 114 of each side plate 103 of the drum unit 26 is located on the bended and extended portion in the width direction.

The joint 306 is formed so that the inward edge of the rail fixing portion 304 in the width direction and the front edge of the rail body 305 are connected. A roller supporting shaft 308 is supported by the joint 306. A rail roller 309 is rotatably supported by the roller supporting shaft 308 on the internal surface of the joint 306 in the width direction. The far top edge of the circumference of the rail roller 309 is positioned above the bottom edge, which is horizontally extended portion, of the rail body 305.

(2) Installation of Drum Unit to the Main Unit Casing

To install the drum unit 26 to the main unit casing 2, first a user may grasp the front handle 111 and the rear handle 113 of the drum unit 26 (see FIG. 3) with both hands and may lift the drum unit 26. Then as shown in FIG. 1, the user may open the front cover 9 to reveal the opening 8 and may insert the drum unit 26 from the opening 8 towards the drum housing space 7.

At this time, the user may roll each of the roller members 118 on the rail body 305. In addition, the user may release a hand from the rear handle 113, and may position each flange part 114 of the drum unit 26 on the left and right rail rollers 309, respectively. Under this condition, the user may push the drum unit 26 to the back so that each of the roller members 118 rolls on the rail body 305, and the flange 114 slides on each of the rail rollers 309. Therefore, the drum unit 26 moves smoothly along the rail rollers 309. In addition, the releasing projection 212 and pressing projection 227 of each developing cartridge 27 slides on a cam containing portion 323 of a holder fixing portion 322, which is described below.

When each of the roller members 118 falls off to the back of each rail roller 309, the flange 114 falls off to the back of each rail roller 309. Each flange 114 is loaded on the portion where the rail body 305 is horizontally extended, the pressing projection 227 and the releasing projection 212 of each developing cartridge 27 are received by a pressing projection receiving portion 325 and a releasing projection receiving portion 326 respectively. Thus, the installation of the drum unit 26 to the main unit casing 2 is completed.

After that, the user may release the hand from the front handle 111, may close the front cover 9, and may conceal the opening 8 by closing the front cover 9. When the front cover 9 is closed, the front handle 111 rotates about the supporting shaft 112 from the standing condition shown in FIG. 4 to the stowed position shown in FIG. 3.

(3) Releasing/Pressing Mechanism

As shown in FIG. 17, the releasing/pressing mechanism 303 includes a translation cam 310, intermediate members 311 (provided for each of the translation cams 310), cam holders 312 (to retain each translation cam 310 so that each translation cam 310 can linearly move in the front and back direction), and a synchronizing moving mechanism 313 (to linearly move a pair of translation cams 310 in a synchronized manner).

Figure 18:
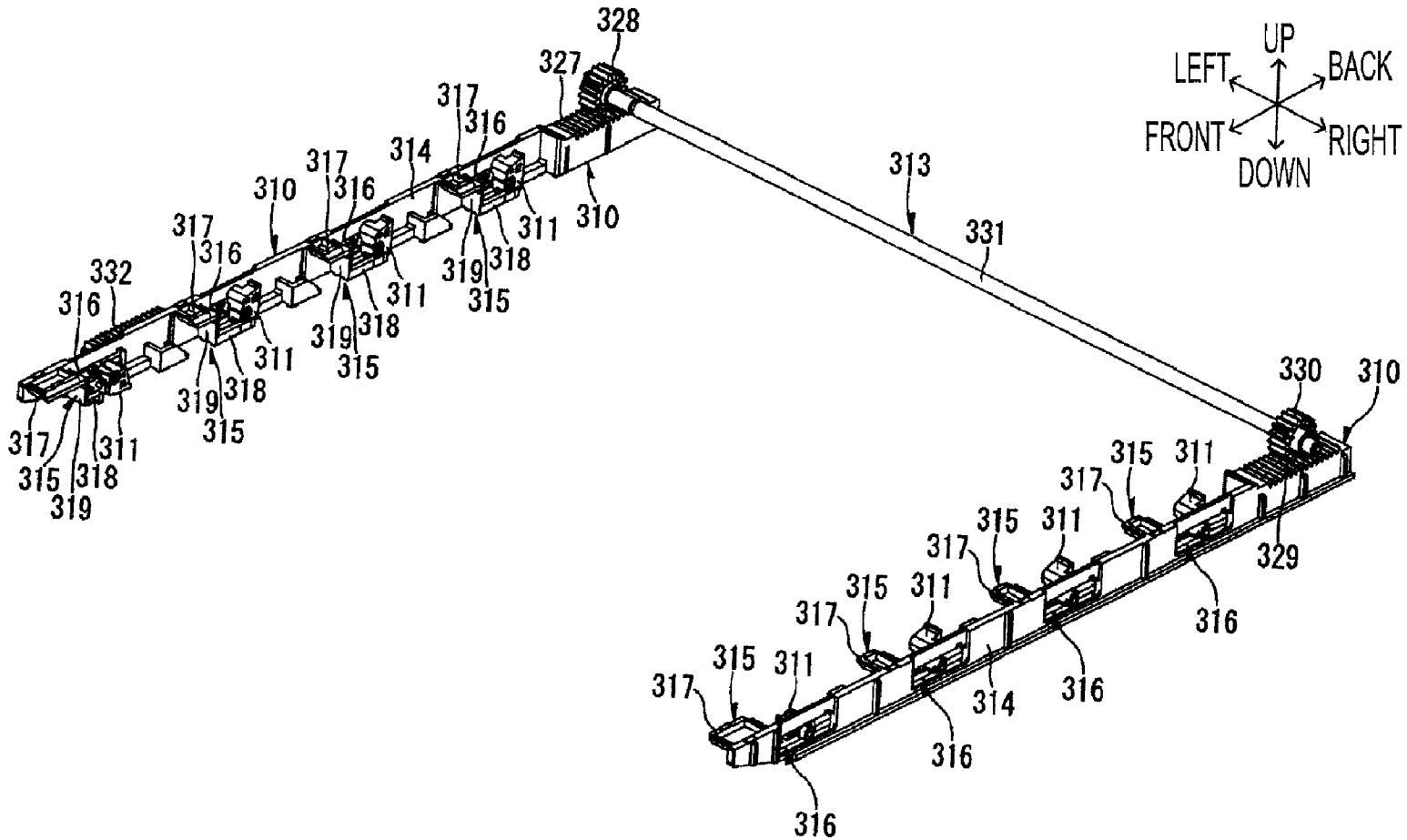
FIG. 18 shows a perspective view of the translation cam member, intermediate member and synchronizing moving mechanism shown in FIG. 17 viewed from the right front top in accordance with aspects of the present invention.
Figure 21:
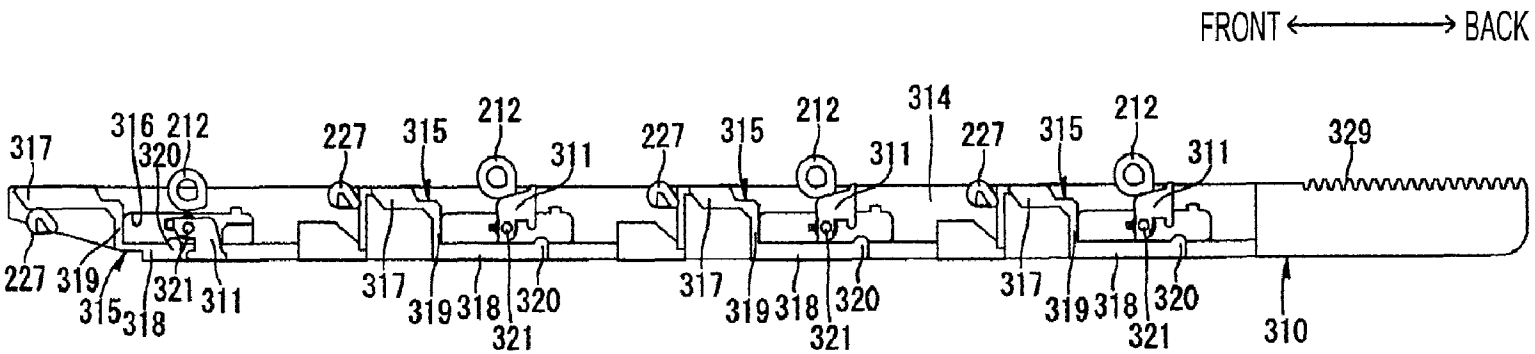
FIG. 21 shows a right lateral view of the translation cam and the intermediate member under the condition in FIG. 19C in accordance with aspects of the present invention.
Figure 22:
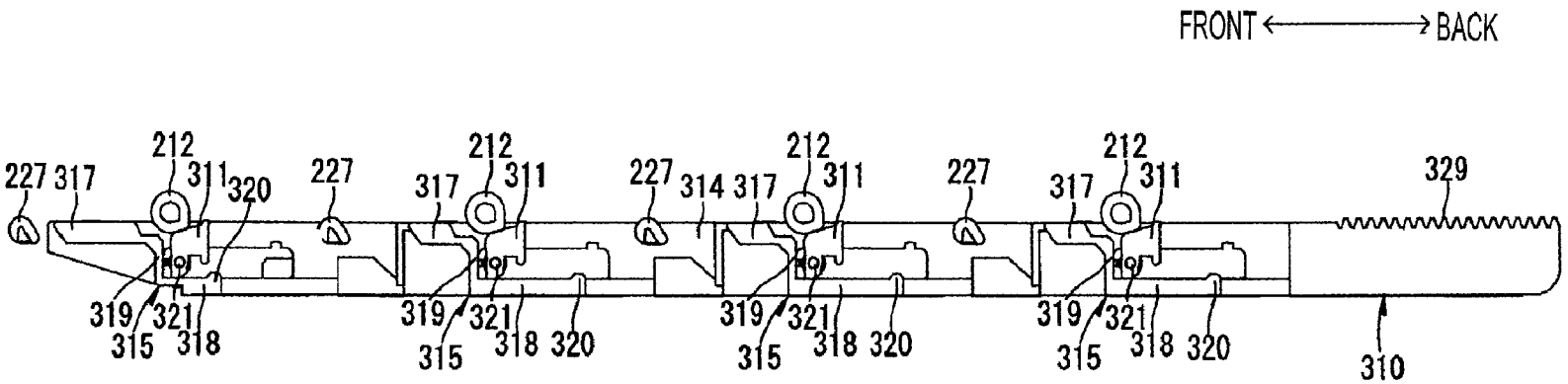
FIG. 22 shows a right lateral view of the translation cam and the intermediate member under the condition in FIG. 19E in accordance with aspects of the present invention.

FIG. 18 is a perspective view of the translation cam 310, the intermediate member 311, and the synchronizing moving mechanism 313 when viewed from the right front top. In other words, FIG. 18 is a perspective view of releasing/pressing mechanism 303 viewed from the right front top while the illustration of cam holders 312 is omitted. FIGS. 19A-19E are perspective views that explain the movement of the translation cam 310 and the intermediate member 311. In addition, FIG. 20 is a right lateral view of the translation cam 310 and the intermediate member 311 under the condition in FIG. 19A. FIG. 21 is a right lateral view of the translation cam 310 and the intermediate member 311 under the condition in FIG. 19C. FIG. 22 is a right lateral view of the translation cam 310 and intermediate member 311 under the condition in FIG. 19E.

The translation cam 310 includes a cam body plate 314 in a thin plate shape, and four operation members 315 that are provided on the internal surface of the cam body plate 314 in the width direction. The cam body plate 314 extends in the front and back direction along the internal surface of the body frame 301 shown in FIG. 15.

Four rectangular holes 316 are formed on the cam body plate 314 in the front and back direction at a constant interval each other. Each of is in rectangular so that the shape of the rectangular hole 316 in the front and back direction is longer.

Each of the four operation members 315 is arranged in front of each of the four rectangular holes 316 respectively. Each of the operation members 315 includes a pressing action portion 317, a release action portion 318, and a joint 319. The pressing action portion 317 is formed in a crank shape when viewed from the side, and extends along the top edge of the cam body plate 314. The pressing action portion 317 is configured to press the pressing projection 227 of the developing cartridge 27 downwardly. The release action portion 318 extends along the bottom edge of the cam body plate 314 and rotates the intermediate member 311 as described below. The joint 319 integrally connects the rear edge of the pressing action portion 317 with the front edge of the release action portion 318.

A projection 320 that projects upwardly is formed on the rear edge of the release action portion 318, as shown in FIGS. 20 to 22.

In addition, the forefront operation member 315 has a different shape compared to the other three operation members 315 (hereinafter referred to as the three back operation members 315). In other words, the pressing action portion 317 of the forefront operation member 315 has a longer length in the front and back direction compared to the pressing action portion 317 of the three back operation members 315. In addition, the release action portion 318 of the forefront operation member 315 has a shorter length in the front and back direction compared to the releasing action portion 318 of the three back operation members 315. Such a difference in the shape and size, as described in detail below, allows (1) the pressing of the developer carrier 39 of all the four developing cartridges 27 against the image carrier 29, (2) the pressing of the developer carrier 39 of only the black developing cartridge 27K against the image carrier 29 and (3) the releasing of the developer carrier 39 of all the developing cartridges 27 from the image carrier 29.

Each of four intermediate members 311 is arranged behind each of the four operation members 315. Each of four intermediate members 311 also faces each of the four rectangular holes 316 in the width direction. As shown in FIGS. 20 to 22, each of the intermediate members 311 is formed in an approximate L shape when viewed from the side. Each of the intermediate members 311 is formed in a block shape including a thickness in the width direction. An intermediate member supporting shaft 321 penetrates one edge of each intermediate member 311 in the width direction so that the intermediate member 311 is rotatably supported by the intermediate member supporting shaft 321. The bottom edge of each intermediate member 311 faces the projection 320 of the release action portion 318 in the front and back direction at an interval under a condition in which each intermediate member 311 does not contact the release action portion 318 (see FIG. 20).

As shown in FIG. 18, the intermediate member supporting shafts 321 are arranged at a constant interval each other in the front and back direction. The interval is substantially equal to the interval between each of the releasing projections 212 under the condition in which the four developing cartridges 27 are installed in the drum unit 26. Each of the intermediate members 311 is supported by each of the intermediate member supporting shafts 321. Each of the intermediate members 311 is inserted into the corresponding rectangular hole 316. Each of the intermediate members 311 is externally extended in the width direction of the cam body plate 314. An internal edge of each of the intermediate members 311 in the width direction is supported by the cam holder 312 so that each of the intermediate members 311 does not rotate.

As shown in FIG. 17, the cam holder 312 includes a holder fixing portion 322 in a thin plate shape that extends in the front and back direction along the internal surface of the body frame 301, and a cam container 323 that extends from the bottom edge of the holder fixing portion 322.

The holder fixing portion 322 is fixed on the internal surface of the body frame 301 by a screw 324.

The cam container 323 is formed with an approximate squared-U-shape from a cross-section view. The cam container 323 extends from the bottom edge of the holder fixing portion 322 inwardly in the width direction for the entire length of the holder fixing portion 322, bends downward, and then externally bends in the width direction. On the cam container 323, four pressing projection receiving portions 325 and four releasing projection receiving portions 326 are formed alternately by continuously cutting the internal surface from the top of the cam container 323 in the width direction. Each of the four pressing projection receiving portions 325 can accept the pressing projection 227 of the developing cartridge 27. Each of the four releasing projection receiving portions 326 can accept the releasing projection 212 of the developing cartridge 27. In other words, four pressing projection receiving portions 326 are positioned in the cam container 323 at the same interval as the interval between each of the pressing projections 227 when each of the developing cartridges 27 is installed in the drum unit 26. Further, four releasing projection receiving portions 326 are positioned at the same intervals as the interval between each of the releasing projections 212 in the pressed condition when each of the developing cartridges 27 is installed in the drum unit 26. Each of the releasing projection receiving portions 326 is arranged behind each of the pressing projection receiving portions 325.

When each of the releasing projections 212 is accepted by each of the releasing projection receiving portions 326, each of the releasing projections 212 downwardly faces each of the intermediate members 311.

The synchronizing moving mechanism 313 has a structure such that the linear motion of the left translation cam 310 is transmitted to the right translation cam 310.

In other words, as shown in FIG. 18, the synchronizing moving mechanism 313 includes a left rack gear 327 formed on the top surface at the rear edge of the left translation cam 310, a left pinion gear 328 that engages with the left rack gear 327, a right rack gear 329 formed on the top surface at the rear edge of the right translation cam 310, a right pinion gear 330 that engages with the right rack gear 329, and a connecting shaft 331 where the left pinion gear 328 and right pinion gear 330 are attached so that the left pinion gear 328 and right pinion gear 330 cannot rotate.

In addition, at the external lateral surface of the left translation cam 310 of the cam body plate 314, an input rack gear 332 is provided in the width direction. The input rack gear 332 is configured to receive the driving force from a motor.

(4) Releasing/Pressing Action

The action of the releasing/pressing mechanism 303 is described by referring to FIGS. 19 to 22.

Figures 19A, 19B, 19C, 19D, 19E:
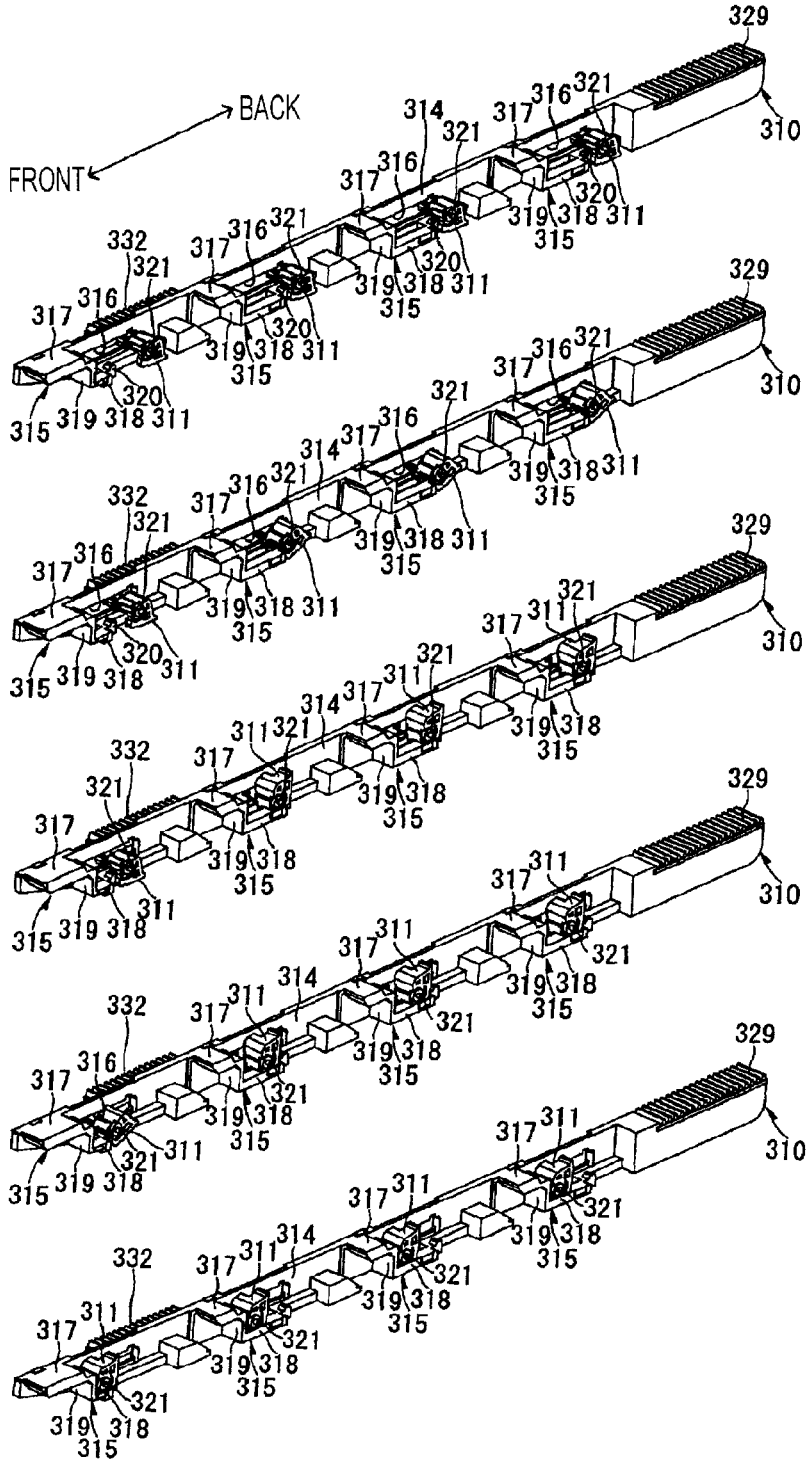
FIGS. 19A-19E show a perspective view that explains the movement of the translation cam and intermediate member shown in FIG. 18 in accordance with aspects of the present invention.
Figure 20:
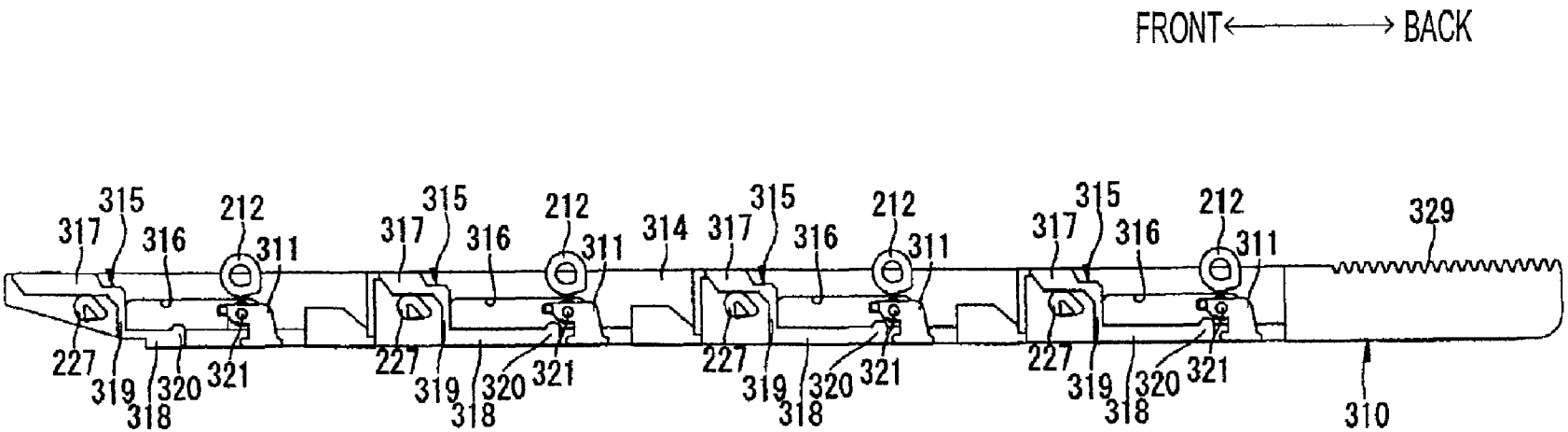
FIG. 20 shows a right lateral view of the translation cam and the intermediate member under the condition in FIG. 19A in accordance with aspects of the present invention.

As shown in FIGS. 19A and 20, when the translation cam 310 is moved to the forefront position, the release action portion 318 of each of the operation members 315 and the intermediate member 311 are facing each other at an interval in the front and back direction without contacting each other. Between the release action portion 318 of the forefront operation member 315 and intermediate member 311, there is an interval larger than the interval between the release action portion 318 of the three back operation members 315 and the intermediate member 311.

In this state, each of the developing cartridges 27 is positioned so that the developer carrier 39 and image carrier 29 come in contact.

The pressing action portion 317 of each of the operation members 315 contacts the pressing projection 227 of each of the developing cartridges 27, and presses each of the pressing projections 227 downwardly. When each of the pressing projections 227 is downwardly pressed, in each developing cartridge 27, as shown in FIG. 14, the handle 214 is pressed against the contacting member 217 by rotating about the supporting shaft 233. Because the contacting member 217 is pressed down by the concave portion 225 of the handle 214, the coil spring 218 is compressed. The pressure due to compression of the coil spring 218 is applied to the top wall 202 of the developing frame 36 so that the developing frame 36 is pressed downwardly. Therefore, the developer carrier 39 is pressed against the image carrier 29. The compression of the coil spring 218 generates a pressure of 1N or greater and 20N or less.

Under this condition, when the driving force of the motor is applied to the input rack gear 332, the left translation cam 310 moves rearward, and then the left pinion gear 328 rotates upon the movement of the left translation cam 310. The rotation of the left pinion gear 328 is transmitted to the right pinion gear 330 via the connecting shaft 331 so that the right pinion gear 330 rotates in the same direction as the left pinion gear 328. The right translation cam 310 moves rearward upon the rotation of the right pinion gear 330.

When the translation cam 310 moves rearward, the engagement between the pressing action portion 317 of the three back operation members 315 and the pressing projection 227 is released, and then the pressure by the pressing projection 227 is released. In addition, as shown in FIG. 19B, the release action portion 318 of the three back operation members 315 contacts the bottom edge of the intermediate member 311 that is arranged on the rear side of the release action portion 318, and then the release action portion 318 presses the bottom edge of the intermediate member 311 towards the rear side of the intermediate member 311. Therefore, each intermediate member 311 rotates about the intermediate member supporting shaft 321 so that the intermediate member 311 is lifted up. In the middle of the rotation of each intermediate member 311, each intermediate member 311 contacts the bottom of the releasing projections 212. In response, an upward force is applied to the releasing projection 212 by each of the intermediate members 311. Thus, the yellow developing cartridge 27Y, magenta developing cartridge 27M, and cyan developing cartridge 27C are lifted up while each developer carrier 39 still contacts each image carrier 29, respectively.

As shown in FIGS. 19C and 21, when the translation cam 310 moves further rearward, the edge, where the intermediate supporting shaft 321 is inserted, of the intermediate member 311 contacts the top of the release action portion 318 of the three back operation members 315. Next, the yellow developing cartridge 27Y, magenta developing cartridge 27M, and cyan developing cartridge 27C are further lifted up and positioned. Accordingly, each developer carrier 39 of the yellow developing cartridge 27Y, magenta developing cartridge 27M and cyan developing cartridge 27C is separated from each image carrier 29.

At this time, the pressing projection 227 of the black developing cartridge 27K is still pressed by the pressing action portion 317 of the operation member 315. Therefore, only the developer carrier 39 of the black developing cartridge 27K is pressed against the image carrier 29.

When the translation cam 310 moves further rearward, the engagement between the pressing action portion 317 of the forefront operation member 315 and the pressing projection 227 of the black developing cartridge 27K is also released. Next, the pressing of the pressing projection 227 by the pressing action portion 317 is released. In addition, as shown in FIG. 19D, the release action portion 318 of the forefront operation members 315 contacts the bottom edge of the intermediate member 311. In response, the release action portion 318 presses the bottom edge of the intermediate member 311 towards the rear. Therefore, each intermediate member 311 rotates about the intermediate member supporting shaft 321 and is lifted. In the middle of the rotation of the intermediate members 311, the intermediate member 311 contacts the releasing projections 212 of the black developing cartridge 27K that are located above the intermediate member 311. When an upward force is applied to the releasing projection 212 as the intermediate members 311 is lifted up, the black developing cartridge 27K is lifted upward while the developer carrier 39 of the black developing cartridge 27K still contacts the image carrier 29.

As shown in FIGS. 19E and 22, when the translation cam 310 moves further rearward, the edge, where the intermediate supporting shaft 321 is inserted, of the intermediate member 311 contacts the top of the release action portion 318 of the forefront operation members 315. Next, the black developing cartridge 27K is further lifted up and moves where the developer carrier 39 of the black developing cartridge 27K is separated from the image carrier 29. Thus, the entire developer carrier 39 of the developing cartridge 27 is released from the image carrier 29.

In accordance with the above described mechanism, when the color laser printer 1 prints an image in black and white, only developer carrier 39 of the black developing cartridge 39 can contact the corresponding image carrier 29, while each developer carrier 39 for other three colors remains separated from the corresponding image carrier 29.

The condition shown in FIG. 19E can be brought back to each of the conditions shown in FIGS. 19A to 19D by moving the translation cam member 310 frontward. By moving the translation cam member 310 frontward, the projection 320 of each of the release action portions 318 engages the intermediate member 311. Thus, the intermediate member 311 rotates downwardly in the direction to be released from the releasing projection 212.

5. Action and Effect

As described above, the developing cartridge 27 includes the coil spring 218 that presses the developing frame 36 so that the developer carrier 39 is pressed against the image carrier 29 and the handle 214 (where the handle 214 transmits the pressing force to the coil spring 218 via the contacting member 217). Therefore, every time the developing cartridge 27 is replaced, a new coil spring 218 and a new handle 214 with a new developing cartridge 27 can be provided to the color laser printer 1. Therefore, an appropriate pressure by the coil spring 218 can be applied. Thus, a preferable pressure condition of the developer carrier 39 against the image carrier 29 can be continuously obtained. Because the coil spring 218 is provided on the developing cartridge 27, even when the specifications of the toner and the developer carrier 39 are changed, the coil spring 218 can apply an optimum pressure.

The coil spring 218 is provided on the developing frame 36 of the developing cartridge 27. This arrangement allows integration of the spring guiding member 216 and the developing frame 36. Therefore, it is not required that the spring guiding member 216 and the developing frame 36 are provided on the handle 214, thereby allowing a simpler structure of the handle 214.

The pressing projection 227 (where pressing force is applied) externally projects from the handle 214 beyond both the sidewall 201 and the releasing/pressing mechanism 303. The concave portion 225 is provided inwardly compared to the sidewall 201. This allows secure acceptance of the pressing force from the releasing/pressing mechanism 303 and stable transmission of the pressure to the coil spring 218.

Rotating the handle 214 allows the handle 214 to come in contact with and be separate from the contacting member 217. When the handle 214 is in contact with the contacting member 217, the handle 214 can be further rotated in the pressing direction. Accordingly, the coil spring 218 is compressed by the pressing force from the releasing/pressing mechanism 303. This allows secure transmission of the pressing force from the handle 214 to the coil spring 218.

The handle 214 is provided so that the user may grasp the handle 214 for easy carrying of the developing cartridge 27. The handle 214 also serves as the pressing member that transmits the pressing force to the coil spring 218 via the contacting member 217. The handle 214 may rotate toward the standing condition when used as a "handle". The handle 214 may also rotate toward the pressing condition when used as a "pressing member". Therefore, the number of parts can be reduced compared to the structure that the "pressing member" and the "handle" are independently provided.

Consequently, while having superior operability of the developing cartridge 27, the number of parts can be reduced.

Two coil springs 218 may be spaced apart in the width direction (the axis direction of the developer carrier 39). The spacing of the coil springs 218 helps prevent and/or minimize the uneven contact of the developer carrier 39 with the image carrier 29. In other words, it is not likely that one edge in the axis direction of the developer carrier 39 is relatively strongly pressed against the image carrier 29 while the other edge is weakly pressed against the image carrier 29. Therefore, the developer carrier 39 can be pressed against the image carrier 29 with even pressure with respect to the axis direction. Consequently, the toner can be supplied from the developer carrier 39 to the image carrier 29 in a favorable manner.

Two coil springs 218 may be positioned at an interval that is approximately the same as the length of the rubber roller 52 in the axis direction of the developer carrier 39. Each coil spring 218 may face each edge of the rubber roller 52 in the top and bottom direction so that both edges in the axis direction of the rubber roller 52 can be securely pressed against the image carrier 29. This arrangement securely minimizes and/or prevents uneven contact of the rubber roller 52 with the image carrier 29. Consequently, the toner can be supplied from the developer carrier 39 to the image carrier 29 in a favorable manner.

The two coil springs 218 in the handle 214 may be provided as a single part. Therefore, the number of parts can be reduced compared to a structure in which an independent part is provided for each of the coil springs 218.

The spring guiding member 216 guides the elastic deformation of the coil spring 218. Therefore, when the pressing force is applied from the handle 214 to the coil spring 218, the coil spring 218 can be elastically deformed while the position of the coil spring 218 in the width direction is stably maintained. Consequently, the developer carrier 39 can be securely pressed against the image carrier 29.

The coil spring 218 generates a pressure between 1N and 20N when a pressing force is applied by the handle 214. As long as the pressure of the coil spring 218 is 1N or greater, it is unlikely that the developer carrier 39 will unevenly contact the image carrier 29 due to a lack of pressure. As long as the pressure of the coil spring 218 is 20N or less, the pressure is not too large and unlikely that the toner attaches to an undesirable area of the image carrier 29 due to excessive pressure.

The proper pressure for each developing cartridge 27 can be independently set by changing the intensity of the coil spring 218. Therefore, the toner in the color that corresponds to each of the developing cartridge 27 can be supplied to each image carrier 29 respectively in a favorable manner.

The developer carrier 39 is provided at the bottom edge of the developing cartridge 27. The developer carrier 39 is pressed downwardly against the image carrier 29. Therefore, the weight of the developing cartridge 27 has an effect of pressing the developer carrier 39 against the image carrier 29. It is understood when the amount of the toner contained in the toner container 43 changes or the design of the developing frame 36 changes, the weight of the developing cartridge 27 also changes. Thus, the pressing condition of the developer carrier 39 against the image carrier 29 also changes. According to the present illustrative embodiment, because the coil springs 218 are provided in the developing cartridge 27, even if the weight of the developing cartridge 27 changes, the developer carrier 39 can be pressed against the image carrier 29 with a desired pressing force by the coil springs 218.

The handle 214 is provided in a rotatable manner between the standing position and the inclined position. Therefore, during the installation of the drum unit 26 to the main unit casing 2, even if an obstacle (for example, a component of the main unit casing 2) exists on the moving track of the handle 214, the handle 214 rotates from the standing position to the inclined position due to a collision with the obstacle, thereby securing a smooth installation of the drum unit 26 in the main unit casing 2.

The color laser printer 1 has a developing cartridge 27 that allows the constant or relatively constant exertion of a favorable pressure condition of the developer carrier 39 against the image carrier 29, allowing the reliable supply of the toner from the developer carrier 39 to the image carrier 29. Therefore, the electrostatic latent image on the image carrier 29 can be developed into the visible image in a preferable manner thereby obtaining a high quality image.

The drum unit 26 can be installed in and removed from the main unit casing 2.

Therefore, the drum unit 26 allows a simplification of the maintenance procedures such as recovering from paper jam or parts replacement. In addition, the developing cartridge 27 can be individually replaced, thereby reducing maintenance cost.

6. Another Illustrative Embodiment of the Developing Cartridge

Figure 23:
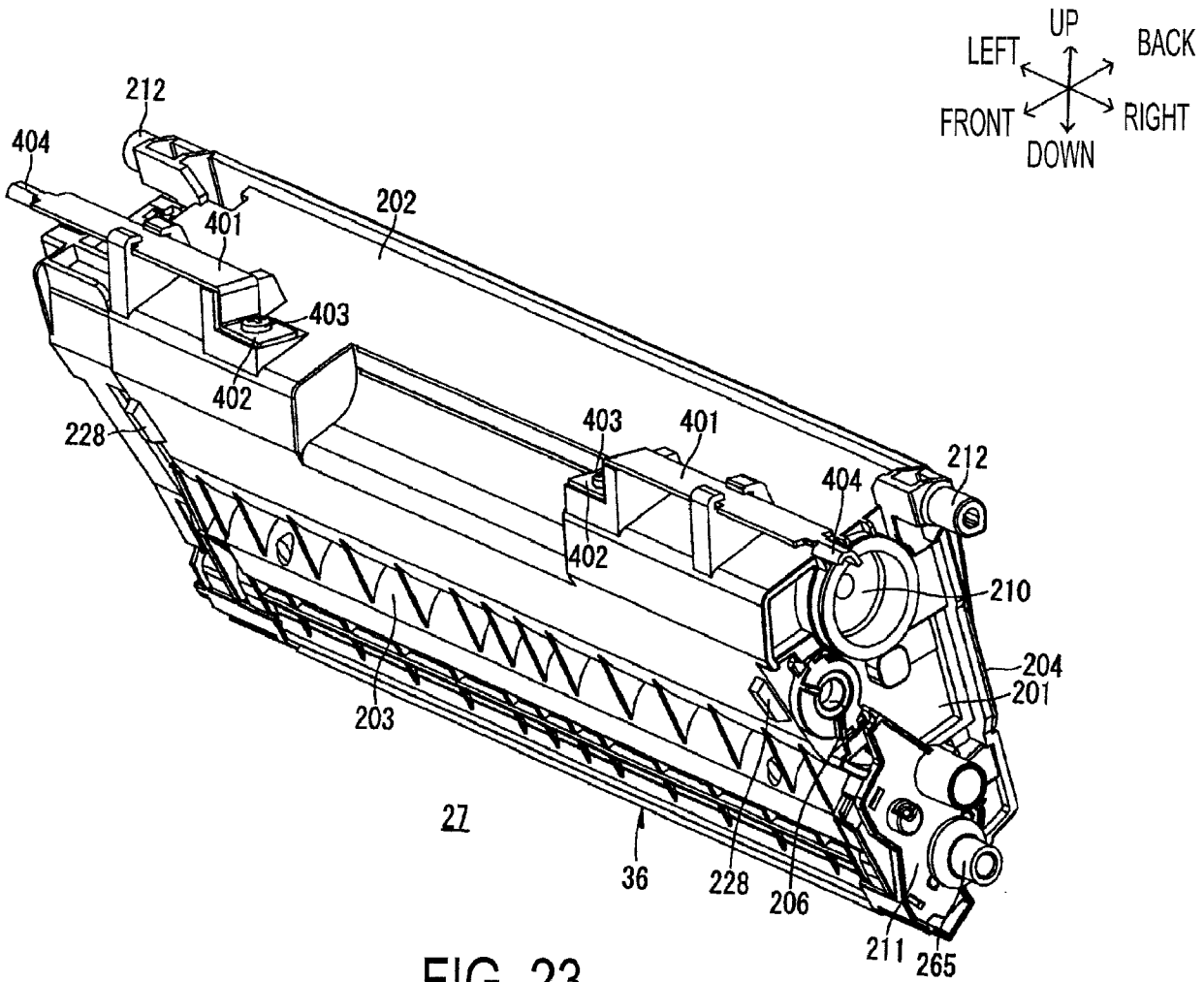
FIG. 23 shows a perspective view that shows another illustrative embodiment (an illustrative embodiment with a plate spring member) of the developing cartridge in accordance with aspects of the present invention.

FIG. 23 is a perspective view that shows another illustrative embodiment of the developing cartridge 27. In FIG. 23, the parts that are equivalent to the parts described in the above illustrative embodiment have the same reference numerals. A detailed description of the parts having the same reference numerals is omitted in the following section.

The developing cartridge 27 according to the present illustrative embodiment does not include the handle 214. Instead, a plate spring 401 is provided on the top wall 202 of the developing frame 36 at both ends in the width direction.

One edge 402 of the plate spring 401 is fixed by a screw 403 on the top surface of the top wall 202. The one edge 402 of the plate spring 401 is bent upward, then externally bent in the width direction, and externally extends toward the sidewall 201 in the width direction. The other edge 404 of the plate spring 401 externally projects in the width direction beyond the sidewall 201 of the developing frame 36. The other edge 404 forms a projection where a pressing force is applied from the pressing action portion 317 of the releasing/pressing mechanism 303.

According to the present illustrative embodiment, when the pressing action portion 317 comes in contact with the other edge 404 downwardly and presses the other edge 404 downward, the plate spring 401 may be elastically deformed so that the pressure of the plate spring 401, due to the elastic deformation, may be applied to the top wall 202 of the developing frame 36. When the developing frame 36 is pressed downwardly, the developer carrier 39 is pressed against the image carrier 29. Therefore, the developing cartridge 27 with the use of the plate spring 401 shown in FIG. 23 can demonstrate the same effect as the developing cartridge 27 with the coil spring 218, which is shown in FIG. 6.

7. Another Illustrative Embodiment of the Developing Cartridge

Figure 24:
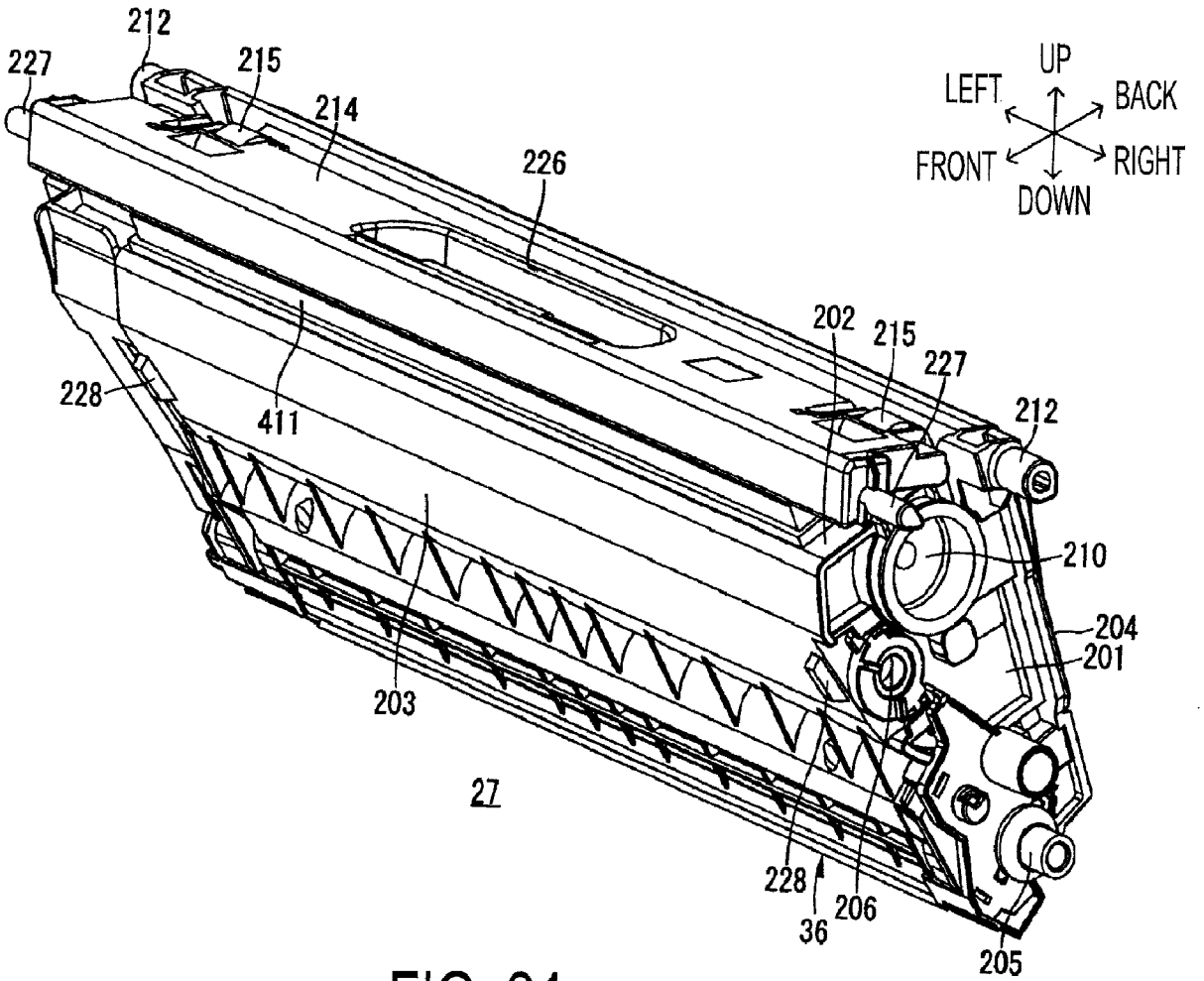
FIG. 24 shows a perspective views that shows another illustrative embodiment (illustrative embodiment with an elastic material provided on the entire width of the top wall of the developing frame in the width direction) of the developing cartridge, the handle is in an inclined condition in accordance with aspects of the present invention.
Figure 25:
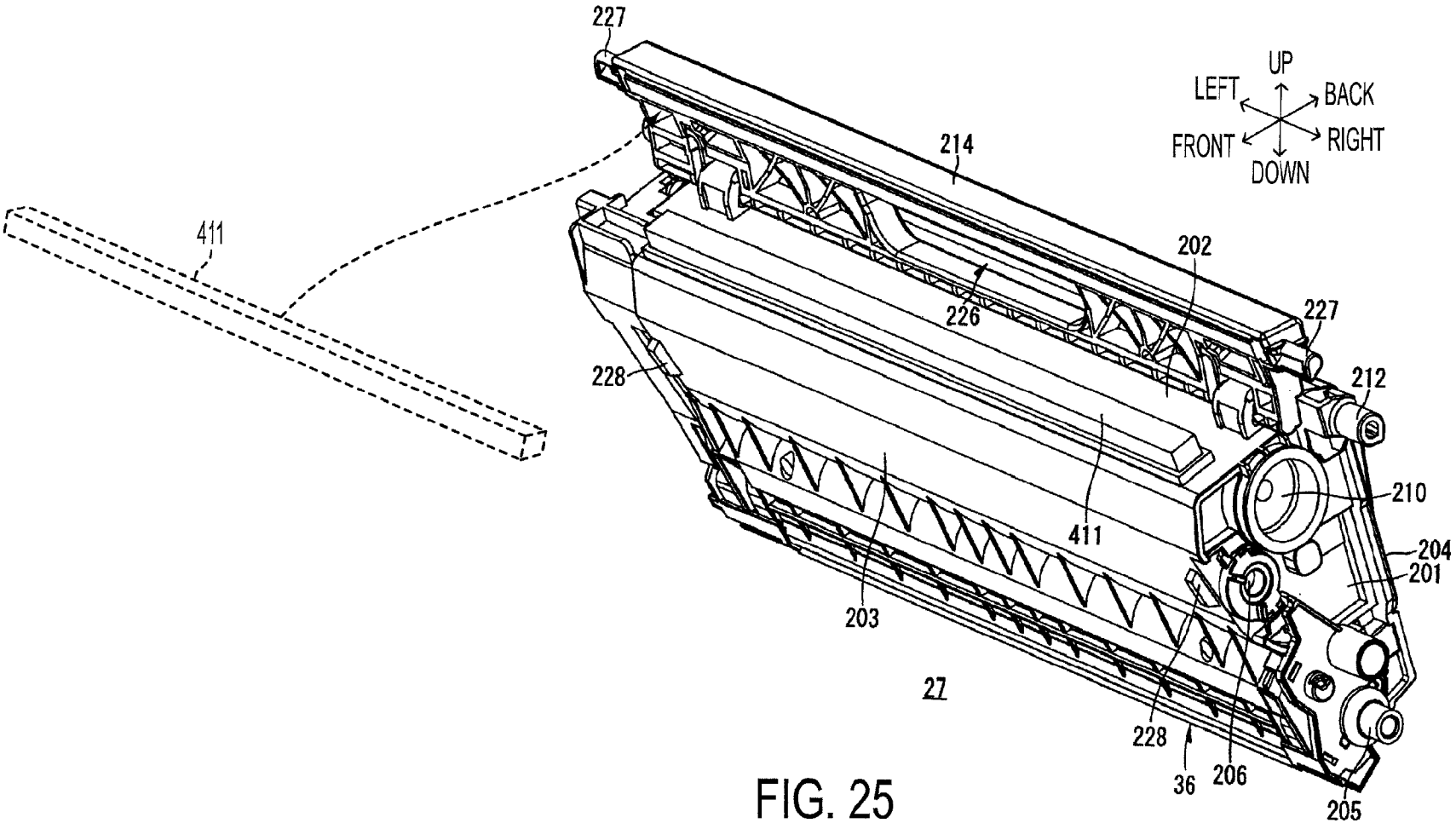
FIG. 25 shows a perspective view of the developing cartridge shown in FIG. 24, the handle is in a standing condition in accordance with aspects of the present invention.

FIGS. 24 and 25 are perspective views that show another illustrative embodiment of the developing cartridge 27. In FIGS. 24 and 25, the parts that are equivalent to the parts described in the above illustrative embodiment have the same reference numerals. A detailed description of the parts having the same reference numerals is omitted in the following section.

The developing cartridge 27 according to the present illustrative embodiment does not include the spring guiding members 216, the contacting members 217 and the coil springs 218. Instead, an elastic member 411 made of elastic material such as sponge or rubber is provided in a square column shape on the front edge of the top wall 202 of the developing frame 36, for the substantially entire width of the developing frame 36 in the axis direction of the developer carrier 39. The elastic material is inherently resilient and can be referred to as a resilient material.

According to the present illustrative embodiment, when the pressing action portion 317 comes in contact with the pressing projection 227 downwardly, and presses each of the pressing projections 227 downward, the handle 214 rotates from the inclined position to the pressing position. The elastic member 411 is pressed by the handle 214 so that the elastic member 411 is compressed. The pressure by the compression of the elastic member 411 is applied to the top wall 202 of the developing frame 36, and then the developing frame 36 is pressed downward so that the developer carrier 39 is pressed against the image carrier 29. Therefore, the developing cartridge 27 with the use of the elastic member 411 shown in FIGS. 24 and 25 can demonstrate the same effect as the developing cartridge 27, which is shown in FIG. 6.

Furthermore, the pressure from the elastic member 411 can be applied along the entire width of the top wall 202 in the width direction. Therefore, the developer carrier 39 can be pressed evenly against the image carrier 29 in the axis direction of the developer carrier 39. Consequently, the toner can be supplied from the developer carrier 39 to the image carrier 29 in a favorable manner.

In another aspect of the invention, elastic member 411 may be provided in sections along the length of top wall 202. This provides the same pressing force although the elastic member is not single, continuous piece.

It is appreciated that the shape of the elastic member 411 may be any shape including but not limited to a square column. Its shape may be rectangular, oval, cigar-shaped, elliptical, multisided, and the like.

In another aspect of the present invention, the developing cartridge 27 according to the present invention may include elastic member 411 that is provided on a lower side of handle 214. In this aspect, the handle 214 has the elastic member 411. The elastic member is not provided on top wall 202 of the developing frame 36. As above, the elastic member 411 may continuous or may be in sections as described above.

In yet a further aspect of the present invention, the elastic member 411 may be provided both on the handle 214 and on the top wall 202 of the developing frame 36. The combination of elastic members 411 being on both the handle 214 and on the top wall 202 may help ensure the pressing force is readily provided to the developing frame 36.

8. Another Illustrative Embodiment of the Developing Cartridge

Figure 26:
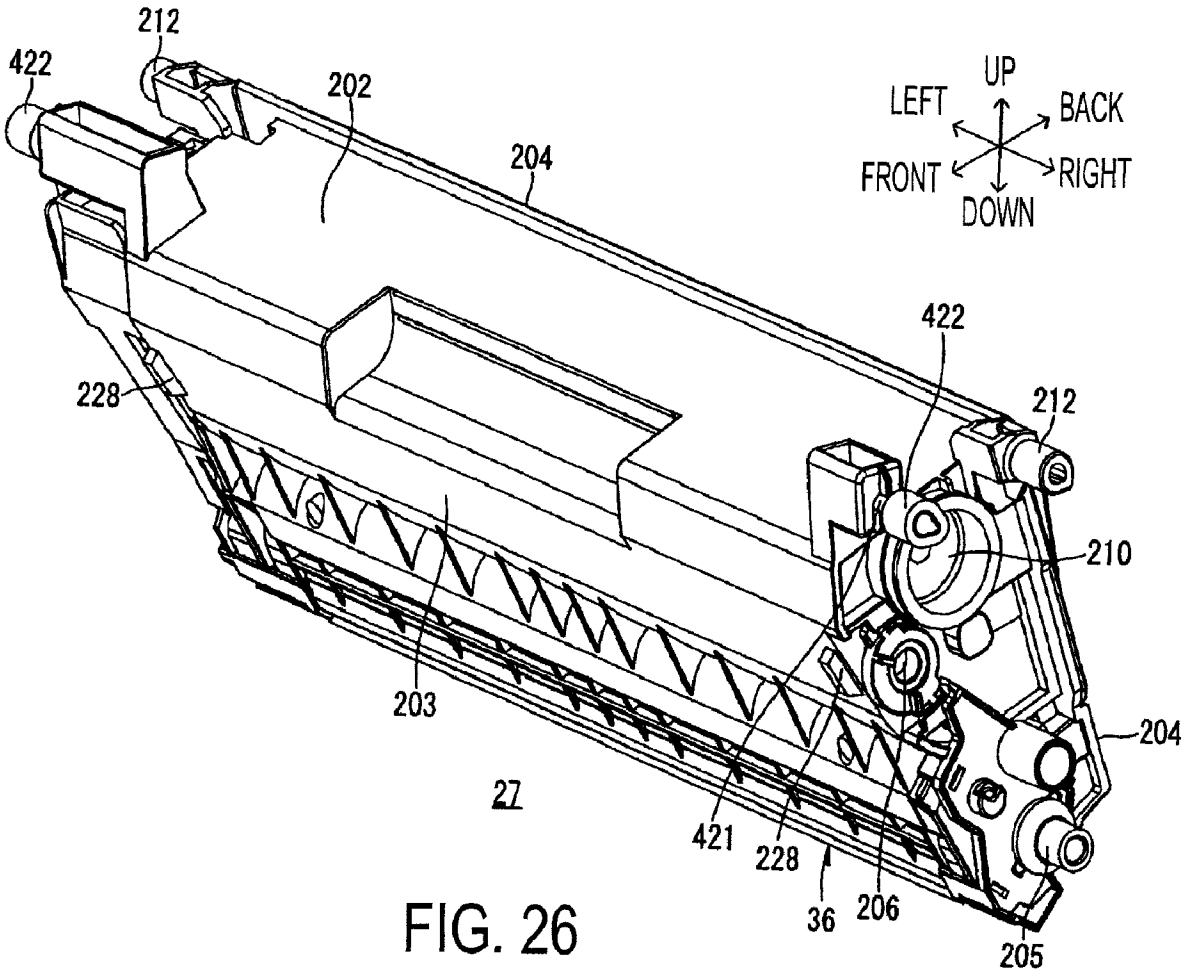
FIG. 26 shows a perspective view that shows another illustrative embodiment of the developing cartridge, the developing cartridge is viewed from the right front top in accordance with aspects of the present invention.
Figure 27:
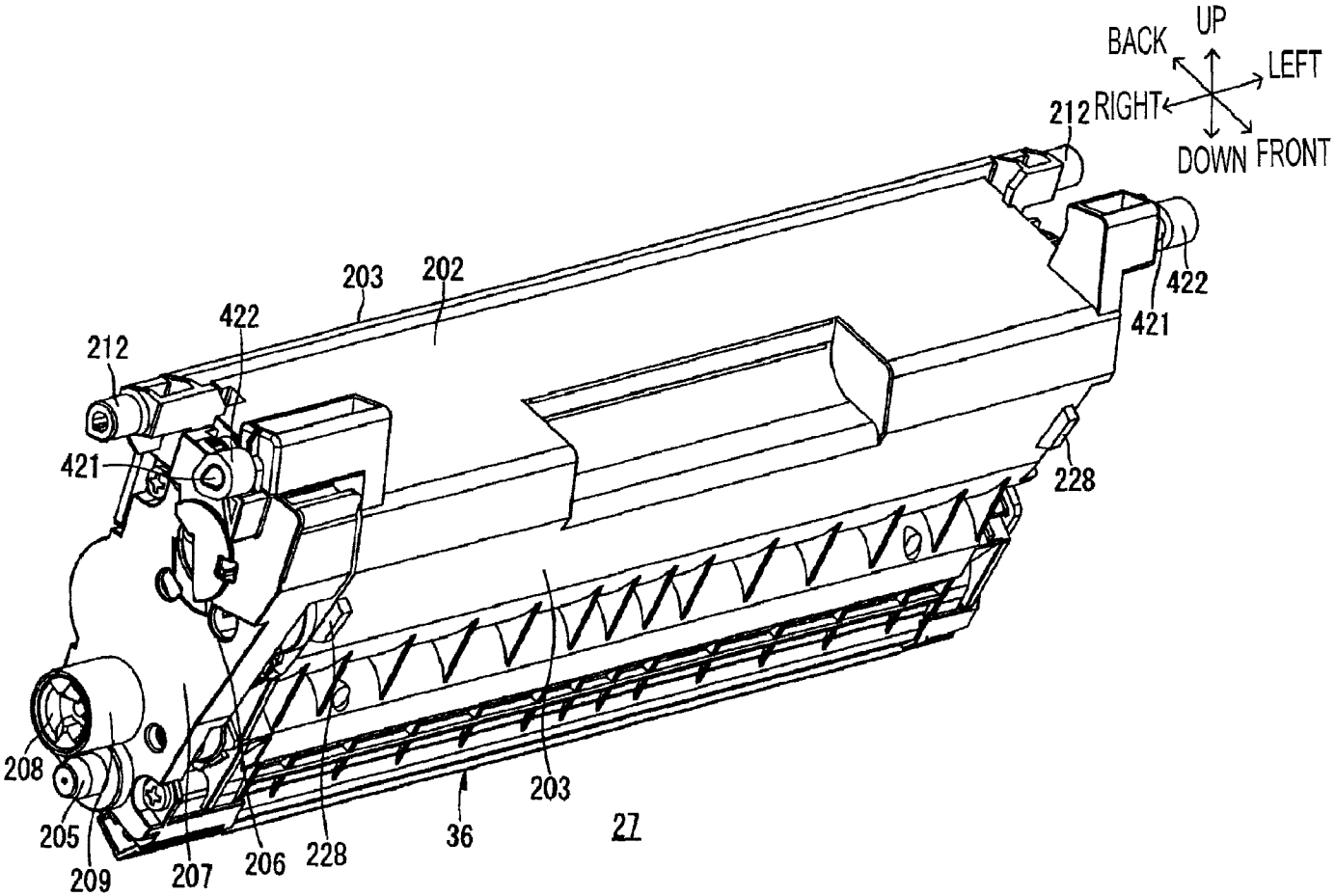
FIG. 27 shows a view of the developing cartridge shown in FIG. 26 viewed from the left front top in accordance with aspects of the present invention.
Figure 28:
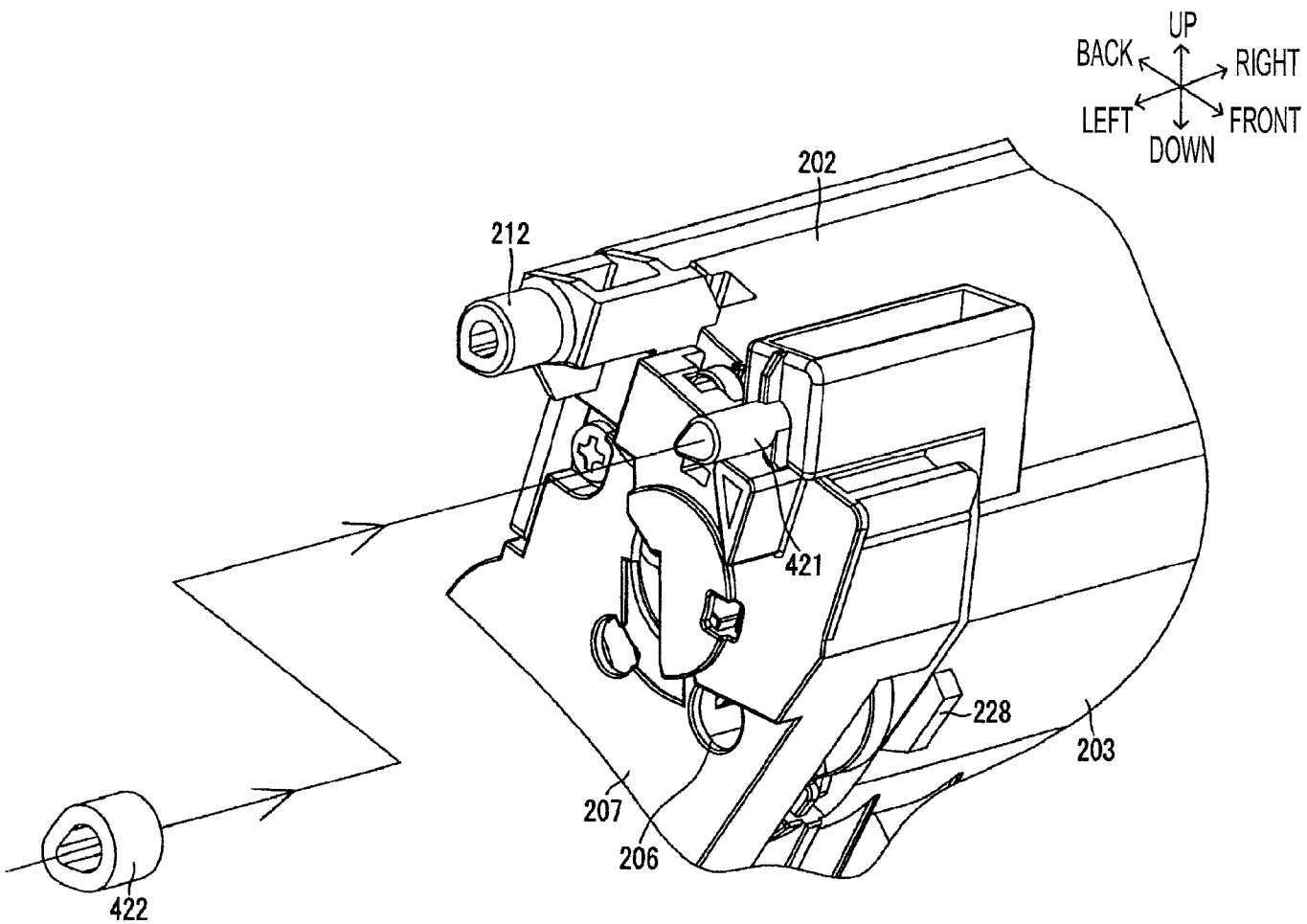
FIG. 28 shows a perspective view of the left top edge of the developing cartridge shown in FIG. 27 in accordance with aspects of the present invention.

FIGS. 26 and 27 are perspective views that show another illustrative embodiment of the developing cartridge 27. FIG. 28 is a perspective view of the left top edge of the developing cartridge 27 shown in FIG. 27. In FIGS. 26, 27 and 28, the parts that are equivalent to the parts described in the above illustrative embodiment have the same reference numerals. A detailed description of the parts having the same reference numerals is omitted in the following section.

The developing cartridge 27 according to the present illustrative embodiment does not include the handle 214. Instead, there are two pressing projections 421, each externally projecting in the width direction at each edge at the front edge of the top wall 202 in the width direction. Each of the pressing projections 421 is integrally formed with the developing frame 36. At the tip of each pressing projection 421, a tube-shaped elastic ring 422 made of elastic material, such as sponge or rubber, is attached.

According to the present illustrative embodiment, the elastic ring 422 is accepted by the pressing projection receiving portion 325 (see FIG. 16). When the pressing action portion 317 downwardly contacts the elastic ring 422 and presses the elastic ring 422 in a downward direction, the elastic ring 422 is elastically deformed. Then, the pressure by the elastic ring 422 due to the elastic deformation is applied to the pressing projection 421. Therefore, the developing frame 36 is pressed downward so that the developer carrier 39 is pressed against the image carrier 29. Therefore, the developing cartridge 27 with the use of the elastic ring 422 can demonstrate the same effect as the developing cartridge 27, which is shown in FIG. 6.

9. Another Illustrative Embodiment of the Developing Cartridge

Figure 29:
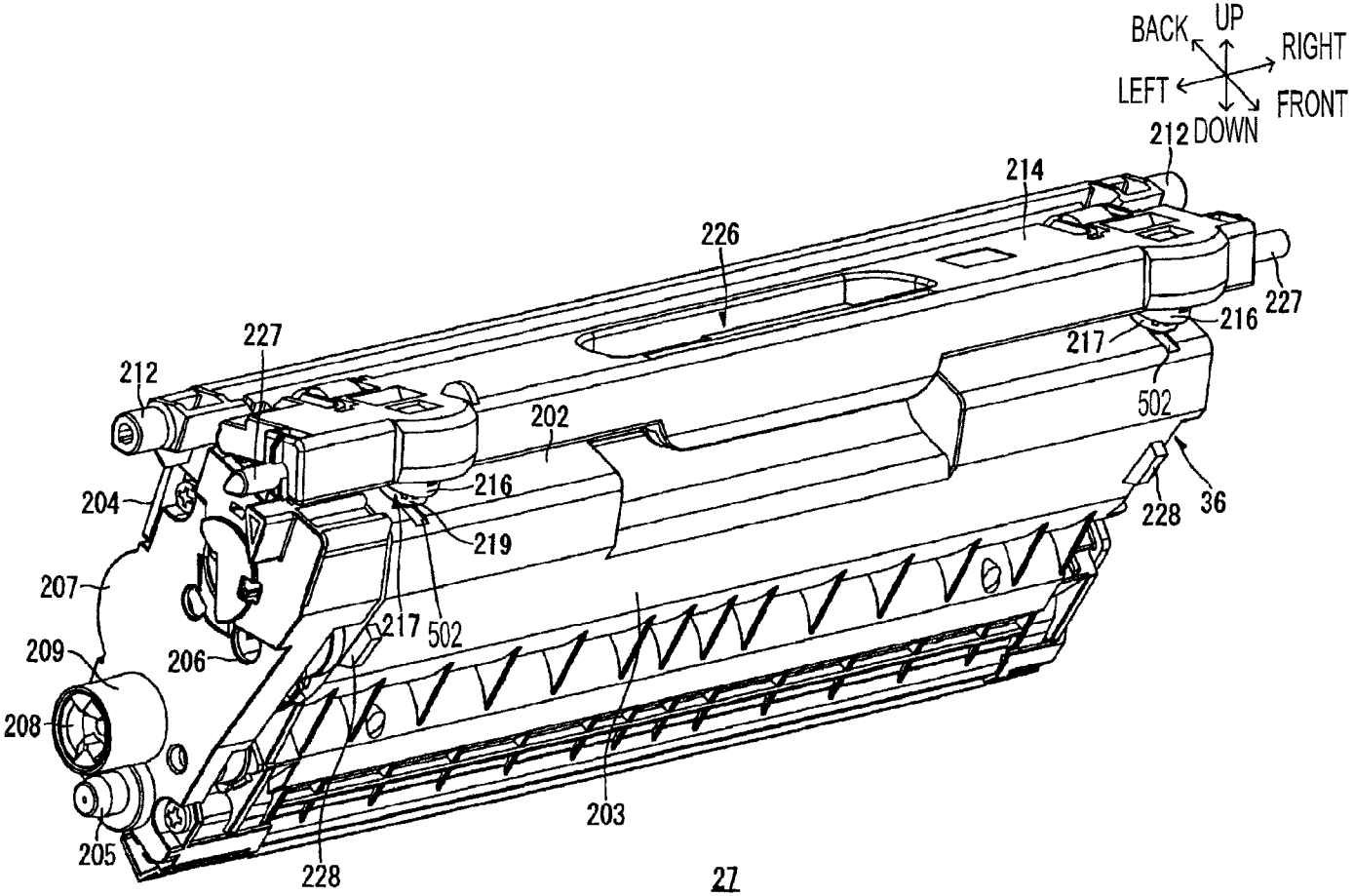
FIG. 29 shows a perspective view that shows another illustrative embodiment (illustrative embodiment with a coil spring on the handle) of the developing cartridge, viewed from the left front with the handle in an inclined condition in accordance with aspects of the present invention.
Figure 30:
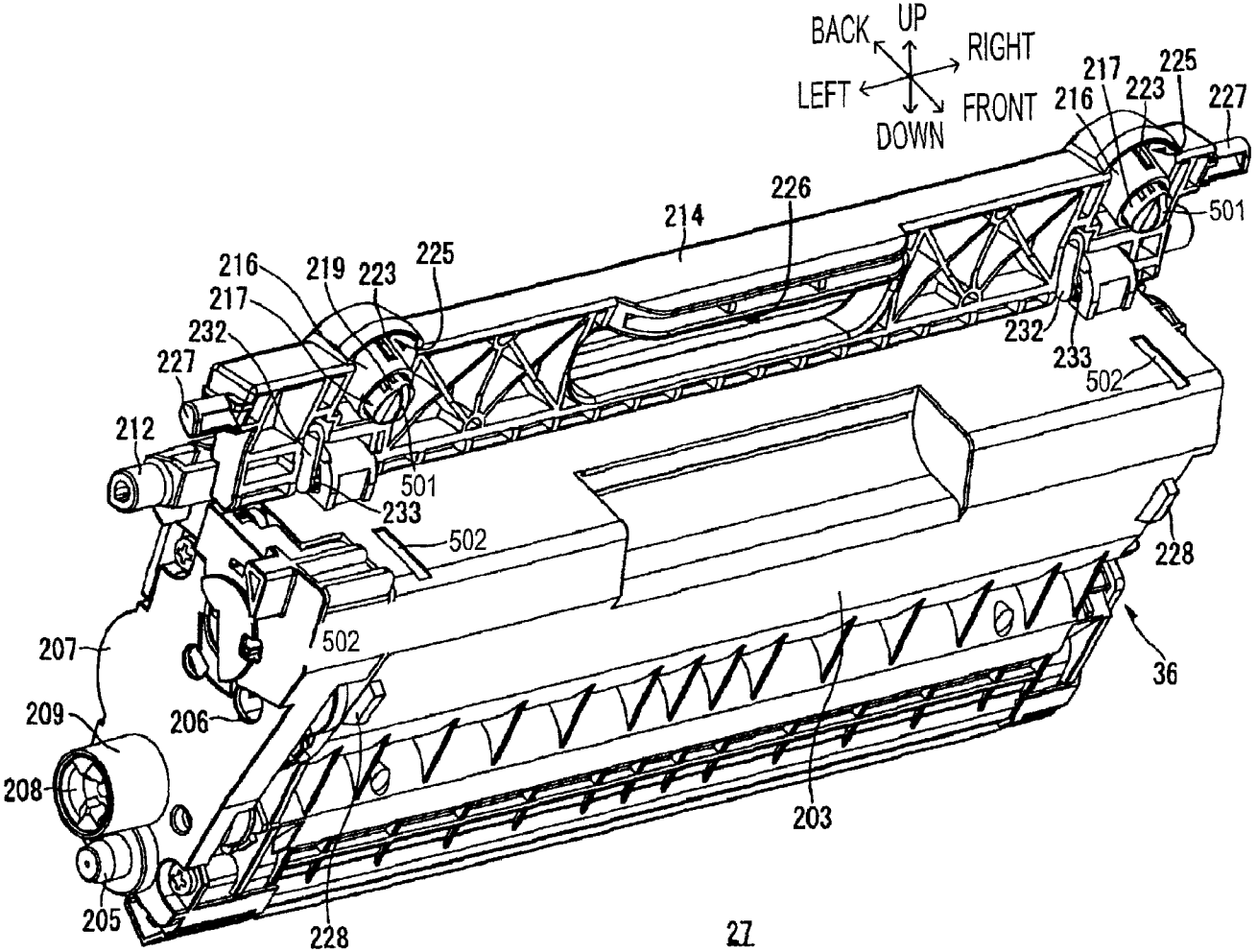
FIG. 30 shows a perspective view of the developing cartridge shown in FIG. 29 viewed from the front left, the handle is in a standing condition in accordance with aspects of the present invention.
Figure 31:
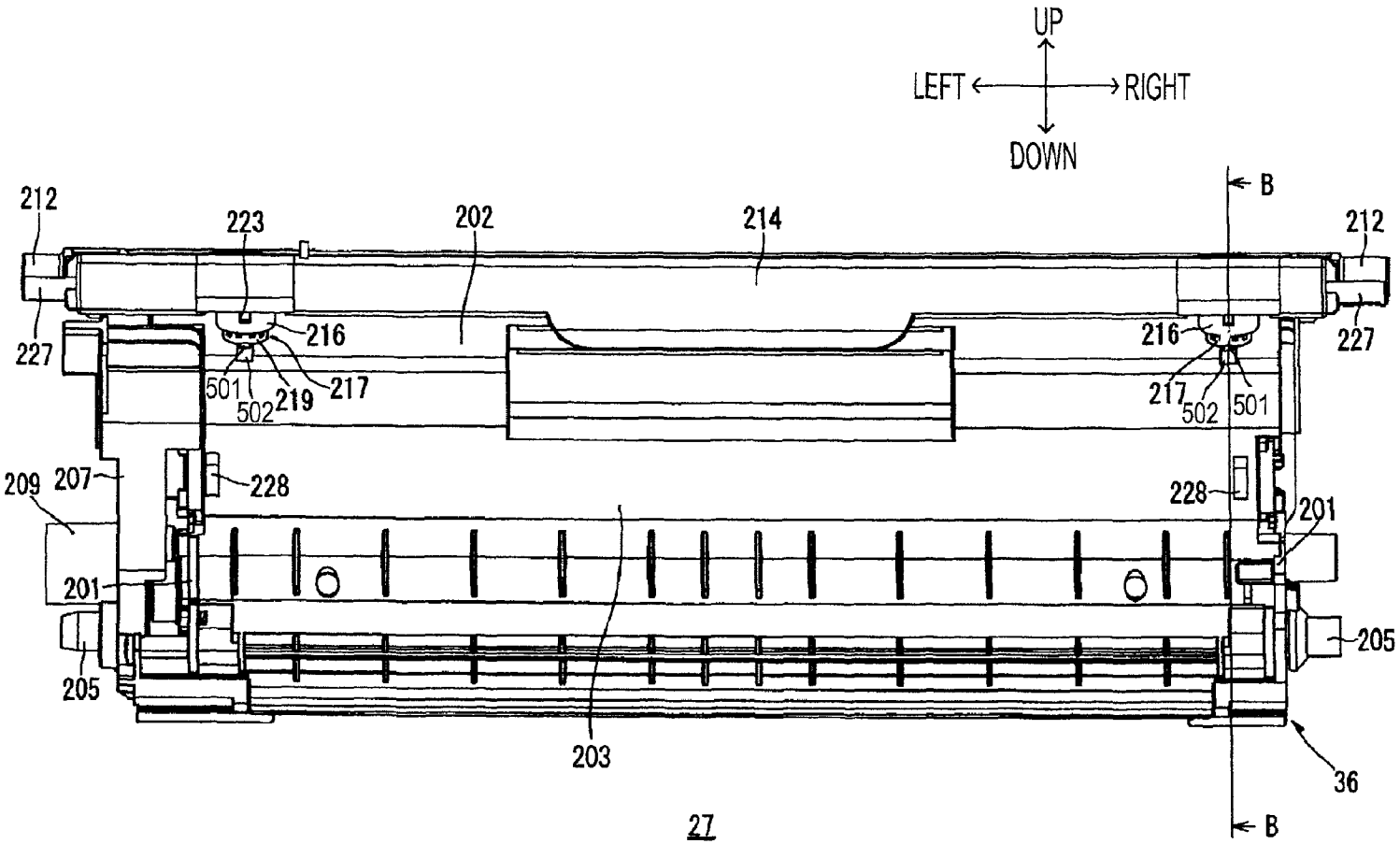
FIG. 31 shows a frontal view of the developing cartridge shown in FIG. 29 viewed from front in accordance with aspects of the present invention.
Figure 32:
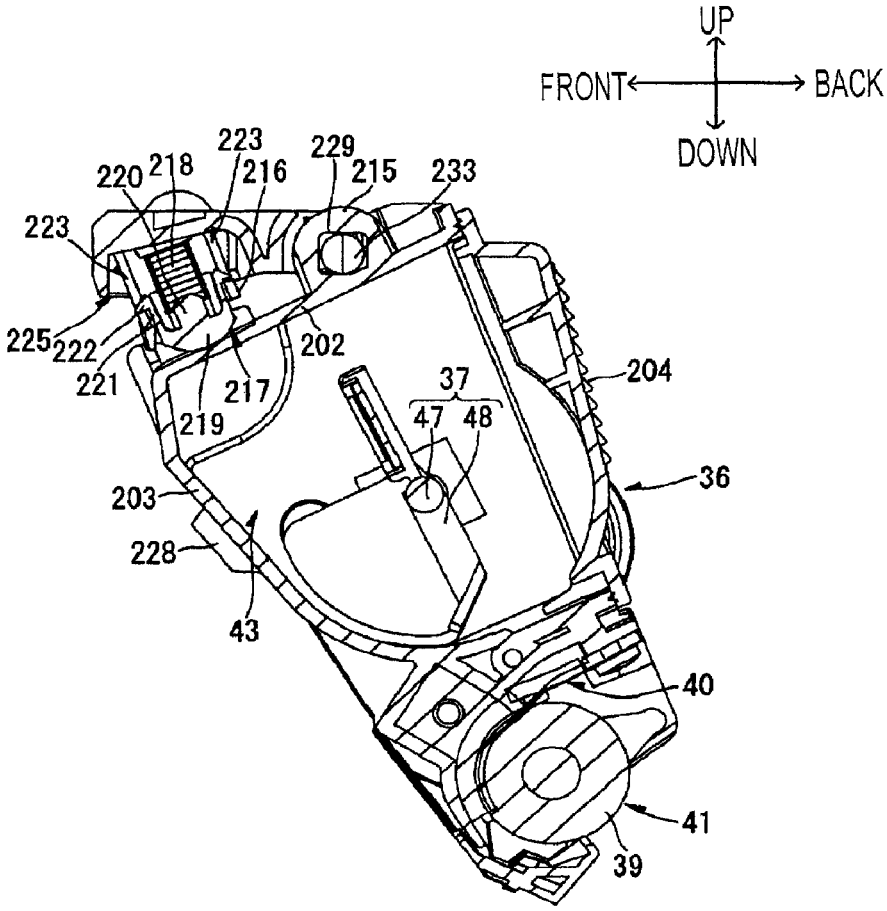
FIG. 32 shows a cross-sectional view of the developing cartridge, which is cut along the cutting line B-B in FIG. 31 in accordance with aspects of the present invention.

FIGS. 29 and 30 are perspective views of another illustrative embodiment of the developing cartridge 27, which is viewed from the left front. In addition, FIG. 31 is a frontal view of the developing cartridge 27 viewed from the front and FIG. 32 is a cross-sectional view that is cut across the line B-B shown in FIG. 31. In FIGS. 29 to 32, the parts that are equivalent to the parts described in the above illustrative embodiment have the same reference numerals. A detailed description of the parts having the same reference numerals is omitted in the following section.

As shown in FIG. 9, the developing cartridge 27 has two spring guiding members 216 provided on the top wall 202 of the developing frame 36. Two concave portions 225, each being capable of accepting the corresponding contacting member 217, are formed in the bottom surface of the handle 214 at the position that corresponds to the contacting member 217.

On the contrary, as shown in FIG. 30, the developing cartridge 27 has two cylinder-shaped spring guiding members 216 formed in each concave portion 225 on the bottom surface of the handle 214. Each guiding member 216 is capable of receiving the contact member 217. The contacting member 217 is formed with a tip 501 at the bottom. On the top wall 202 of the developing frame 36 a receiving groove 502 is formed that can accept the tip 401 of the corresponding contact member 217, as shown in FIGS. 29 to 31.

More specifically, each of the spring guiding members 216 is integrally formed with the handle 214. The tip of each of the spring guiding members 216 externally projects beyond the concave portion 225. A plurality of grooves 223 extend from the handle 214 in the axis direction of the guiding member 216 so that the plurality of grooves 223 surrounds each of the spring guiding members 216.

As shown in FIG. 32, each of the latching tags 222 latches the groove 223 of the spring guiding member 216 so that the main body 219 of the contacting member 217 projects from the guiding member 216. The tip 501 of the main body 219 is an approximate semicircle when viewed from the side and has a rib shape that extends in the front and back direction. Of course, the tip 501 may have any shape as desired to contact various surfaces.

The coil spring 218 is provided in a compressed condition between the bottom surface of the handle 214 and the contacting member 217. The coil spring 218 presses the contacting member 217 in the direction so that the coil spring 218 can be released from the spring guiding member 216.

When the handle 214 is positioned in the inclined condition, the tip 501 of each contacting member 217 is accepted by each receiving groove 502 so that each tip 501 comes in contact with each receiving groove 402 provided on the top wall 202 of the developing frame 36. When the handle 214 rotates from the inclined condition to the pressing condition, each contacting member 217 is pressed towards the handle 214, and each coil spring 218 is compressed. The pressure by the compression of each coil spring 218 is applied to the top wall 202 of the developing frame 36 from each of the contacting members 217 via the receiving groove 502. Consequently, the developing frame 36 is pressed downward and then the developer carrier 39 is pressed against the image carrier 29.

As described above, the spring guide member 216, the contacting member 217, and the coil spring 218 can be provided on the handle 214. Use of the structure can minimize or eliminate the requirement of those members to be provided on the developing frame 36, thereby allowing simplification of the developing frame 36.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Numerous other embodiments, modifications, and variations within the scope and spirit of the appended claims will occur to persons of ordinary skill in the art from a review of this disclosure.

What is claimed is:

1. A developing cartridge comprising:

a case configured to contain developer, the case including a pair of first walls and a second wall, the second wall extending between the pair of first walls;

a developer carrier configured to be rotatable about a rotational axis extending in a direction parallel to the second wall, an elastic member located near the second wall and configured to press the second wall in a first direction perpendicular to the rotational axis; and a pressing member located near the second wall and configured to press the elastic member in the first direction, wherein the elastic member is located between the second wall and the pressing member.

2. The developing cartridge according to claim 1, wherein the pressing member is located at a portion projecting outside of the case.

3. The developing cartridge according to claim 1, wherein the elastic member is configured to apply a first pressing force to the case, and wherein the pressing member is configured to move based on receiving a second pressing force.

4. The developing cartridge according to claim 3, wherein the pressing member is configured to convey the second pressing force to the elastic member.

5. The developing cartridge according to claim 1, wherein the pressing member is configured to pivot relative to the case.

6. The developing cartridge according to claim 1, wherein the pressing member is a handle.

7. The developing cartridge according to claim 1, wherein the elastic member is attached to the case.

8. The developing cartridge according to claim 7, wherein the elastic member is a coil spring.

9. The developing cartridge according to claim 7, wherein the pressing member is a handle.

10. The developing cartridge according to claim 7, wherein the elastic member is made of a resilient material.

11. The developing cartridge according to claim 7, wherein the elastic member has a length approximately identical to a length of the developer carrier.

12. The developing cartridge according to claim 7, wherein the elastic member is a plate spring.

13. The developing cartridge according to claim 1, wherein the elastic member is mounted on the pressing member.

14. The developing cartridge according to claim 13, wherein the pressing member is a handle that is attached to the case.

15. The developing cartridge according to claim 13, wherein the elastic member is a coil spring, the pressing member being attached to the case.

16. The developing cartridge according to claim 13, wherein the elastic member is a ring.

17. The developing cartridge according to claim 13, wherein the elastic member is made of a resilient material.

18. The developing cartridge according to claim 13, wherein the elastic member has a length approximately identical to a length of the developer carrier.

19. The developing cartridge according to claim 1, wherein the elastic member includes at least two elastic members that are separated from each other in a direction parallel to the rotational axis.

20. The developing cartridge according to claim 19, wherein the elastic members are separated from each other by approximately a length of the developer carrier.

21. The developing cartridge according to claim 1, further comprising:

a guide member that guides the deformation of the elastic member.

22. A developing cartridge comprising:

a case configured to contain developer;

a developer carrier configured to be rotatable about a rotational axis extending in a first direction;

an elastic member configured to press the case; and a pressing member including a base and a projection that externally projects from the base in a second direction parallel to the first direction, the base being configured to press the elastic member, the projection being configured to receive an external pressing force.

* * * * *